US010495017B2

(12) United States Patent
Nonaka et al.

(10) Patent No.: US 10,495,017 B2
(45) Date of Patent: Dec. 3, 2019

(54) PORTABLE WORKING MACHINE INCLUDING ENGINE WITH CARBURETOR AND FUEL SUPPLY CONTROL METHOD THEREOF

(71) Applicant: Yamabiko Corporation, Tokyo (JP)

(72) Inventors: Takumi Nonaka, Tokyo (JP); Shirou Yamaguchi, Tokyo (JP); Toru Kono, Tokyo (JP); Genichi Sato, Tokyo (JP); Yuta Iihara, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 0 days.

(21) Appl. No.: 15/954,634

(22) Filed: Apr. 17, 2018

(65) Prior Publication Data

US 2018/0334980 A1 Nov. 22, 2018

(30) Foreign Application Priority Data

May 17, 2017 (JP) ..... 2017-098572

(51) Int. Cl.
*F02D 41/24* (2006.01)
*F02M 9/12* (2006.01)
(Continued)

(52) U.S. Cl.
CPC ..... *F02D 41/2422* (2013.01); *F02M 9/085* (2013.01); *F02M 9/12* (2013.01);
(Continued)

(58) Field of Classification Search
CPC ..... F02D 41/2422; F02D 41/2451; F02D 41/1497; F02D 41/2445; F02D 2200/021;
(Continued)

(56) References Cited

U.S. PATENT DOCUMENTS

2001/0018900 A1 9/2001 Matsuda et al.
2011/0004395 A1 1/2011 Neubauer et al.
2013/0255629 A1 10/2013 Yamashita et al.

FOREIGN PATENT DOCUMENTS

DE 3439841 A1 5/1985
DE 102009031707 A1 1/2011
(Continued)

OTHER PUBLICATIONS

Extended European Search Report issued in corresponding European Patent Application No. 18171263.9 dated Dec. 13, 2018 (6 pages).

*Primary Examiner* — Xiao En Mo
(74) *Attorney, Agent, or Firm* — Kilyk & Bowersox, P.L.L.C.

(57) ABSTRACT

To optimize fuel supply of an engine with a carburetor during engine operation, a throttle opening degree detection sensor detecting a throttle opening degree and a control unit controlling a valve body variably controlling an opening degree of a fuel discharge part or a fuel supply passage based on a map are included. The map includes a plurality of sections divided based on the throttle opening degree and an opening degree of the valve body set for each section. The opening degree of the valve body set for each section is the opening degree of the valve body at which the engine rotation speed is highest in each section. The control unit controls an electric actuator driving the valve body to achieve the opening degree of the valve body set in a section to which the throttle opening degree detected by the throttle opening degree detection sensor belongs out of the plurality of sections.

8 Claims, 35 Drawing Sheets

(51) Int. Cl.
*F02M 9/08* (2006.01)
*F02M 19/04* (2006.01)
*F02M 35/04* (2006.01)

(52) U.S. Cl.
CPC ..... *F02M 19/04* (2013.01); *F02D 2400/06* (2013.01); *F02M 35/044* (2013.01)

(58) Field of Classification Search
CPC ..... F02D 41/2448; F02D 41/2416; F02D 2200/0404; F02D 2200/101; F02D 33/006; F02D 2400/06; F02M 7/00; F02M 19/04; F02M 9/12; F02M 9/085; F02M 35/044
See application file for complete search history.

(56) References Cited

FOREIGN PATENT DOCUMENTS

| | | | |
|---|---|---|---|
| EP | 2492485 | A1 | 8/2012 |
| EP | 2787194 | A2 | 10/2014 |

FIG.6B (BASIC STEP)

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | ··· n ··· | | | 13 | 14 | 15 | 16 |
| STEP | *** | *** | *** | *** | *** | *** | *** | *** | *** | *** | *** | *** | *** | *** |
| EXECUTION OF OPTIMIZATION PROCESS | NOT-YET | NOT-YET | NOT-YET | NOT-YET | NOT-YET | NOT-YET | NOT-YET | NOT-YET | NOT-YET | NOT-YET | NOT-YET | NOT-YET | NOT-YET | NOT-YET |

FIG.7B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | *** | *** | CHANGE ① | *** | *** | *** | *** | *** | *** | *** | *** | *** | *** |
| EXECUTION OF OPTIMIZATION PROCESS | NOT-YET | NOT-YET | NOT-YET | EXECUTE | NOT-YET | NOT-YET | NOT-YET | NOT-YET | NOT-YET | NOT-YET | NOT-YET | NOT-YET | NOT-YET | NOT-YET |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ② | CHANGE ② | CHANGE ② | CHANGE ② | CHANGE ② | CHANGE ② | CHANGE ② | CHANGE ② | CHANGE ② | *** |
| EXECUTION OF OPTIMIZATION PROCESS | NOT-YET | CHANGE | CHANGE | DONE | CHANGE | CHANGE | CHANGE | CHANGE | CHANGE | CHANGE | CHANGE | CHANGE | CHANGE | NOT-YET |

SECTIONS 1 TO 2 ARE INTERPOLATED FROM BASIC STEP SECTION 0 AND STEP OF SECTION 3

SECTIONS 4 TO 15 ARE INTERPOLATED FROM STEP OF SECTION 3 AND BASIC STEP OF WOT

FIG.8B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ② | CHANGE ② | CHANGE ② | CHANGE ② | CHANGE ② | CHANGE ② | CHANGE ③ | CHANGE ② | CHANGE ② | *** |
| EXECUTION OF OPTIMIZATION PROCESS | NOT-YET | — | — | DONE | — | — | — | — | — | — | EXECUTE | — | — | NOT-YET |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ④ | CHANGE ④ | CHANGE ④ | CHANGE ④ | CHANGE ④ | CHANGE ④ | CHANGE ③ | CHANGE ④ | CHANGE ④ | *** |
| EXECUTION OF OPTIMIZATION PROCESS | NOT-YET | — | — | DONE | CHANGE | CHANGE | CHANGE | CHANGE | CHANGE | CHANGE | DONE | CHANGE | CHANGE | NOT-YET |

SECTIONS 4 TO 12 ARE INTERPOLATED AND OVERWRITTEN FROM RESULTS OF SECTION 3 AND 13

SECTIONS 14 AND 15 ARE INTERPOLATED AND OVERWRITTEN FROM SECTION 13 AND BASIC STEP OF WOT (※ IF NOT-YET EXECUTED IN IDLE, INTERPOLATION IS PERFORMED BY REFERENCE TO BASIC STEP OF SECTION 0)

FIG.9B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ④ | CHANGE ④ | CHANGE ④ | CHANGE ④ | CHANGE ④ | CHANGE ④ | CHANGE ③ | CHANGE ④ | CHANGE ④ | CHANGE ⑤ |
| EXECUTION OF OPTIMIZATION PROCESS | NOT-YET | – | – | DONE | – | – | – | – | – | – | DONE | – | – | EXECUTE |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ④ | CHANGE ④ | CHANGE ④ | CHANGE ④ | CHANGE ④ | CHANGE ④ | CHANGE ③ | CHANGE ⑥ | CHANGE ⑥ | CHANGE ⑤ |
| EXECUTION OF OPTIMIZATION PROCESS | NOT-YET | – | – | DONE | – | – | – | – | – | – | DONE | CHANGE | CHANGE | DONE |

SECTIONS 14 AND 15 ARE INTERPOLATED AND OVERWRITTEN FROM RESULTS OF SECTION 13 AND WOT

※IF EXECUTION OF OPTIMIZATION IS DONE IN NO SECTION IN POT REGION, INTERPOLATION IS PERFORMED BY REFERENCE TO IDLE (SECTION 3)

※IF NOT-YET EXECUTED ALSO IN IDLE (SECTION 3), INTERPOLATION IS PERFORMED BY REFERENCE TO BASIC STEP OF SECTION 0

FIG.10B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ④ | CHANGE ④ | CHANGE ⑦ | CHANGE ④ | CHANGE ④ | CHANGE ④ | CHANGE ③ | CHANGE ⑥ | CHANGE ⑥ | CHANGE ⑤ |
| EXECUTION OF OPTIMIZATION PROCESS | NOT-YET | – | – | DONE | – | – | EXECUTE | – | – | – | DONE | – | – | DONE |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ⑧ | CHANGE ⑧ | CHANGE ⑦ | CHANGE ⑧ | CHANGE ⑧ | CHANGE ⑧ | CHANGE ③ | CHANGE ⑥ | CHANGE ⑥ | CHANGE ⑤ |
| EXECUTION OF OPTIMIZATION PROCESS | DONE | – | – | DONE | CHANGE | CHANGE | DONE | CHANGE | CHANGE | CHANGE | DONE | – | – | DONE |

INTERPOLATION IS PERFORMED IN BOTH DIRECTIONS TOWARD IDLE/WOT BASED ON SECTION 6 TO SECTION IN WHICH EXECUTION OF OPTIMIZATION IS DONE

FIG.11B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ⑧ | CHANGE ⑧ | CHANGE ⑦ | CHANGE ⑧ | CHANGE ⑧ | CHANGE ⑧ | CHANGE ⑨ | CHANGE ⑥ | CHANGE ⑥ | CHANGE ⑤ |
| EXECUTION OF OPTIMIZATION PROCESS | NOT-YET | – | – | DONE | – | – | DONE | – | – | – | EXECUTE | – | – | DONE |

※SECTION 13 IS OVERWRITTEN

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE ② | CHANGE ② | CHANGE ① | CHANGE ⑧ | CHANGE ⑧ | CHANGE ⑦ | CHANGE ⑩ | CHANGE ⑩ | CHANGE ⑩ | CHANGE ⑨ | CHANGE ⑩ | CHANGE ⑩ | CHANGE ⑤ |
| EXECUTION OF OPTIMIZATION PROCESS | NOT-YET | – | – | DONE | – | – | DONE | CHANGE | CHANGE | CHANGE | DONE | CHANGE | CHANGE | DONE |

REPEAT

INTERPOLATION IS PERFORMED IN BOTH DIRECTIONS TOWARD IDLE/WOT BASED ON SECTION 13 TO SECTION IN WHICH EXECUTION OF OPTIMIZATION IS DONE

STEPS OF ALL SECTIONS FROM IDLE TO WOT FINALLY HAVE OPTIMUM VALUES

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | CHANGE | CHANGE | CHANGE | CHANGE | CHANGE | CHANGE | CHANGE | CHANGE | CHANGE | CHANGE | CHANGE | CHANGE | CHANGE |
| EXECUTION OF OPTIMIZATION PROCESS | NOT-YET | – | – | DONE | DONE | DONE | DONE | DONE | DONE | DONE | DONE | DONE | DONE | DONE |

FIG.13B (BASIC STEP)

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | *** | *** | *** | *** | *** | *** | *** | *** | *** | *** | *** | *** | *** |
| EXECUTION OF OPTIMIZATION PROCESS | NOT-YET | NOT-YET | NOT-YET | NOT-YET | NOT-YET | NOT-YET | NOT-YET | NOT-YET | NOT-YET | NOT-YET | NOT-YET | NOT-YET | NOT-YET | NOT-YET |

FIG.14B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | *** | *** | CHANGE ① | *** | *** | *** | *** | *** | *** | *** | *** | *** | *** |
| EXECUTION OF OPTIMIZATION PROCESS | NOT-YET | NOT-YET | NOT-YET | EXECUTE | NOT-YET | NOT-YET | NOT-YET | NOT-YET | NOT-YET | NOT-YET | NOT-YET | NOT-YET | NOT-YET | NOT-YET |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ② | CHANGE ② | CHANGE ② | CHANGE ① | CHANGE ② | CHANGE ② | CHANGE ② | CHANGE ② | CHANGE ② | CHANGE ② | CHANGE ② | CHANGE ② | CHANGE ② | CHANGE ② |
| EXECUTION OF OPTIMIZATION PROCESS | CHANGE | CHANGE | CHANGE | DONE | CHANGE | CHANGE | CHANGE | CHANGE | CHANGE | CHANGE | CHANGE | CHANGE | CHANGE | CHANGE |

STEP NUMBERS OF ALL SECTIONS ARE CHANGED BASED ON RESULT OF SECTION 3

FIG.15B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ② | CHANGE ② | CHANGE ② | CHANGE ① | CHANGE ② | CHANGE ② | CHANGE ② | CHANGE ② | CHANGE ② | CHANGE ② | CHANGE ③ | CHANGE ② | CHANGE ② | CHANGE ② |
| EXECUTION OF OPTIMIZATION PROCESS | – | – | – | DONE | – | – | – | – | – | – | EXECUTE | – | – | – |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ④ | CHANGE ④ | CHANGE ④ | CHANGE ④ | CHANGE ④ | CHANGE ④ | CHANGE ④ | CHANGE ④ | CHANGE ④ | CHANGE ④ | CHANGE ③ | CHANGE ④ | CHANGE ④ | CHANGE ④ |
| EXECUTION OF OPTIMIZATION PROCESS | CHANGE | CHANGE | CHANGE | CHANGE | CHANGE | CHANGE | CHANGE | CHANGE | CHANGE | CHANGE | DONE | CHANGE | CHANGE | CHANGE |

STEP NUMBERS OF ALL SECTIONS ARE CHANGED BASED ON RESULT OF SECTION 13

FIG.16B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ④ | CHANGE ④ | CHANGE ④ | CHANGE ④ | CHANGE ④ | CHANGE ④ | CHANGE ④ | CHANGE ④ | CHANGE ④ | CHANGE ④ | CHANGE ③ | CHANGE ④ | CHANGE ④ | CHANGE ⑤ |
| EXECUTION OF OPTIMIZATION PROCESS | – | – | – | DONE | – | – | – | – | – | – | DONE | – | – | EXECUTE |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ⑥ | CHANGE ⑥ | CHANGE ⑥ | CHANGE ⑥ | CHANGE ⑥ | CHANGE ⑥ | CHANGE ⑥ | CHANGE ⑥ | CHANGE ⑥ | CHANGE ⑥ | CHANGE ⑥ | CHANGE ⑥ | CHANGE ⑥ | CHANGE ⑤ |
| EXECUTION OF OPTIMIZATION PROCESS | CHANGE | CHANGE | CHANGE | CHANGE | CHANGE | CHANGE | CHANGE | CHANGE | CHANGE | CHANGE | CHANGE | CHANGE | CHANGE | DONE |

STEP NUMBERS OF ALL SECTIONS ARE CHANGED BASED ON RESULT OF SECTION 16

⇩ REPEAT

FIG.17B (BASIC STEP)

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | *** | *** | *** | *** | *** | *** | *** | *** | *** | *** | *** | *** | *** |
| EXECUTION OF OPTIMIZATION PROCESS | NOT-YET | NOT-YET | NOT-YET | NOT-YET | NOT-YET | NOT-YET | NOT-YET | NOT-YET | NOT-YET | NOT-YET | NOT-YET | NOT-YET | NOT-YET | NOT-YET |

FIG.18B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | *** | *** | *** | CHANGE ① | *** | *** | *** | *** | *** | *** | *** | *** | *** | *** |
| EXECUTION OF OPTIMIZATION PROCESS | NOT-YET | NOT-YET | NOT-YET | EXECUTE | NOT-YET | NOT-YET | NOT-YET | NOT-YET | NOT-YET | NOT-YET | NOT-YET | NOT-YET | NOT-YET | NOT-YET |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ② | CHANGE ② | CHANGE ② | CHANGE ① | CHANGE ② | CHANGE ② | CHANGE ② | CHANGE ② | CHANGE ② | CHANGE ② | CHANGE ② | CHANGE ② | CHANGE ② | CHANGE ② |
| EXECUTION OF OPTIMIZATION PROCESS | CHANGE | CHANGE | CHANGE | DONE | CHANGE | CHANGE | CHANGE | CHANGE | CHANGE | CHANGE | CHANGE | CHANGE | CHANGE | CHANGE |

STEP NUMBERS OF ALL SECTIONS ARE CHANGED BASED ON RESULT OF SECTION 3

FIG.19B

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ② | CHANGE ② | CHANGE ② | CHANGE ① | CHANGE ② | CHANGE ② | CHANGE ② | CHANGE ② | CHANGE ② | CHANGE ② | CHANGE ③ | CHANGE ② | CHANGE ② | CHANGE ② |
| EXECUTION OF OPTIMIZATION PROCESS | — | — | — | DONE | — | — | — | — | — | — | EXECUTE | — | — | — |

⇩

| | LOWER THAN IDLE | | | IDLE | POT REGION | | | | | | | | | WOT |
|---|---|---|---|---|---|---|---|---|---|---|---|---|---|---|
| SECTION | 0 | 1 | 2 | 3 | 4 | 5 | 6 | … n … | | | 13 | 14 | 15 | 16 |
| STEP | CHANGE ② | CHANGE ② | CHANGE ② | CHANGE ① | CHANGE ④ | CHANGE ④ | CHANGE ④ | CHANGE ④ | CHANGE ④ | CHANGE ④ | CHANGE ③ | CHANGE ④ | CHANGE ④ | CHANGE ② |
| EXECUTION OF OPTIMIZATION PROCESS | — | — | — | DONE | CHANGE | CHANGE | CHANGE | CHANGE | CHANGE | CHANGE | DONE | CHANGE | CHANGE | — |

STEP NUMBERS OF ALL SECTIONS ARE CHANGED BASED ON RESULT OF SECTION 13

PORTABLE WORKING MACHINE INCLUDING ENGINE WITH CARBURETOR AND FUEL SUPPLY CONTROL METHOD THEREOF

BACKGROUND OF THE INVENTION

The present application claims priority from Japanese Patent Application No. 2017-098572, filed May 17, 2017, which is incorporated herein by reference.

The present invention relates to a portable working machine such as a bush cutter and a chain saw and, more particularly, to a portable working machine including an engine with a carburetor and a fuel supply control method thereof.

A portable working machine such as a bush cutter, a chain saw, a power blower, and a trimmer employs an internal combustion engine, for example, a two-stroke engine, as a drive source and employs a carburetor. Obviously, the portable working machine can employ a four-stroke engine as the driving source.

The carburetor has an intra-carburetor air passage through which air filtered by an air cleaner passes and has a fuel discharge part discharging fuel to the intra-carburetor air passage. The fuel discharge part is supplied with fuel from a fuel source through a fuel supply passage. The carburetor allows the air passing through the intra-carburetor air passage to suck out the fuel from the fuel discharge part and thereby generates an air-fuel mixture.

Before shipping portable working machines, a manufacturer performs adjustment to optimize an amount of the fuel (fuel supply) discharged through the fuel discharge part. The fuel supply passage is generally provided with a manual needle valve, and the fuel supply is adjusted by adjusting the valve opening degree of this needle valve. With this adjustment, individual differences of working machines to be shipped are eliminated, and the operation of the working machines to be shipped is optimized.

However, the environment (e.g., atmospheric pressure, temperature) is not the same when users use the working machines. A type of fuel used is also different. Therefore, it is necessary for users to readjust the fuel supply. This readjustment is not easy for many users.

Patent Document 1 discloses a carburetor with a solenoid valve disposed in a fuel supply passage and a portable working machine incorporating the same. The valve opening degree of the solenoid valve is electronically controlled by using a rotation speed sensor detecting the engine rotation speed. Specifically, in the fuel supply control disclosed in Patent Document 1, after completion of a warming-up operation, the valve opening degree of the solenoid valve is feedback-controlled while detecting the engine rotation speed with the rotation speed sensor such that a preset target rotation speed is achieved without a load and with wide open throttle ("full throttle"). The valve opening degree of the solenoid valve capable of achieving the target rotation speed without a load is stored in the memory.

When a work is performed by using the working machine, the engine rotation speed decreases due to a load acting on the engine. In Patent Document 1, the valve opening degree of the solenoid valve is corrected based on a difference between the target rotation speed without a load and the engine rotation speed detected under a load. This correction amount is obtained from a map prepared in advance. In the map, a correction amount corresponding to each difference is predefined by using the engine rotation speed corresponding to the difference as a parameter.

Patent Document 1: Japanese Laid-Open Patent Publication 2013-204552 (counterpart US2013/0255629A1)

As described above, in Patent Document 1, the fuel supply control is carried out based on the engine rotation speed detected by the rotation speed sensor. A work with a chain saw is performed with wide open throttle.

On the other hand, a brush cutter is not limited to the operation with wide open throttle (full throttle). The work may be performed with a partial throttle opening degree depending on a state of grass to be cut. The cutting blades of the brush cutter include metal blades and plastic blades (nylon cords) immediately worn when used, and the nylon cords and the metal blades are selectively attached to the brush cutter for use. Since the magnitude of the load acting on the engine differs between the nylon cords and the metal blades, the rotation speed is different when the throttle valve is wide open. With the wide-open throttle valve (full throttle), the metal blades provide a rotation speed exceeding 10,000 rpm, while long nylon cords result in 6,000 rpm, for example. Additionally, the nylon cords change in length due to wear during use. Therefore, when the nylon cords are used, the load acting on the engine varies every moment during work.

Although the fuel supply control disclosed in Patent Document 1 may be able to optimize the fuel supply under limited conditions, the optimization of the fuel supply is practically impossible in the fuel supply control based on the rotational speed, particularly, in a partial operation or a work using nylon cords.

SUMMARY OF THE INVENTION

An object of the present invention is to provide a portable working machine capable of optimizing a fuel supply of an engine with a carburetor during operation of the engine and a fuel supply control method thereof.

Another object of the present invention is to provide a portable working machine capable of optimizing a fuel supply particularly in a partial operation and a fuel supply control method thereof.

Yet another object of the present invention is to provide a portable working machine and a fuel supply control method capable of optimizing a fuel supply.

A further object of the present invention is to provide a portable working machine and a fuel supply control method capable of optimizing a fuel supply not only after the engine has warmed up but also while the engine is warming up from a cold state of the engine.

According to a viewpoint of the present invention, referring to FIG. 22, the technical problem described above is solved by providing a portable working machine driven by an internal combustion engine including a carburetor having an intra-carburetor air passage receiving air filtered by an air cleaner, an output control valve linked to an output control operating member operated by a user and generating a throttle opening degree corresponding to an operation of the output control operating member, a fuel discharge part discharging fuel into the intra-carburetor air passage, a fuel supply passage supplying fuel to the fuel discharge part, and a valve body disposed in the fuel discharge part or the fuel supply passage and driven by an electric actuator, the valve body variably controlling an opening degree of the fuel discharge part or the fuel supply passage, the portable working machine comprising:

a throttle opening degree detection sensor detecting the throttle opening degree; and a control unit controlling the valve body based on a map, wherein the map includes a plurality of sections divided based on the throttle opening degree and an opening degree of the valve body set for each section, wherein the opening degree of the valve body set for each of the sections is the opening degree of the valve body at which the engine rotation speed is highest in each section, and wherein the control unit controls the electric actuator to achieve the opening degree of the valve body set in a section to which the throttle opening degree detected by the throttle opening degree detection sensor belongs out of the plurality of sections.

According to another viewpoint of the present invention, the technical problem described above is solved by providing a fuel supply control method of a portable working machine driven by an internal combustion engine including a carburetor having an intra-carburetor air passage receiving air filtered by an air cleaner, an output control valve linked to an output control operating member operated by a user and generating a throttle opening degree corresponding to an operation of the output control operating member, a fuel discharge part discharging fuel into the intra-carburetor air passage, a fuel supply passage supplying fuel to the fuel discharge part, and a valve body disposed in the fuel discharge part or the fuel supply passage and driven by an electric actuator, the valve body variably controlling an opening degree of the fuel discharge part or the fuel supply passage, the method comprising:

preparing a control map including a plurality of sections divided based on the throttle opening degree and an opening degree of the valve body set for each section such that the opening degree of the valve body set for each of the sections is the opening degree of the valve body at which the engine rotation speed is highest in each section;

a throttle opening degree detection step of detecting the throttle opening degree; and a control step of controlling the electric actuator based on the opening degree of the valve body set in a section of the control map to which the throttle opening degree detected at the throttle opening degree detection step belongs.

Effects and further objects of the present invention will become apparent from the following detailed description of preferred embodiments.

BRIEF DESCRIPTION OF THE DRAWINGS

FIGS. 6A and 6B show diagrams for explaining a basic step of the optimization process executed in the embodiment, including FIG. 6A showing basic step numbers (original set values) of a map stored in a memory at the time of factory shipment as a line and FIG. 6B showing a list of map data including the basic step numbers.

FIGS. 7A and 7B show diagrams for explaining a first method, including FIG. 7A showing a diagram for explaining a best search process executed in an idle state (a third section) and an optimization process of reflecting the step number in the third section acquired thereby to the set step numbers (set values) of the other sections when an engine of the working machine is activated and FIG. 7B showing a list of updated map data.

FIGS. 8A and 8B show diagrams for explaining a best search process executed in a thirteenth section and an optimization process of reflecting the step number in the thirteenth section acquired thereby to the set step numbers (set values) of the other sections, and FIG. 8B shows a list of updated map data, in a stage after the optimization process described in FIG. 7.

FIGS. 9A and 9B show diagrams for explaining a best search process executed in a sixteenth section (WOT) and an optimization process of reflecting the step number in the sixteenth section acquired thereby to the set step numbers (set values) of the other sections, and FIG. 9B shows a list of updated map data, in a stage after the optimization process described in FIG. 8.

FIGS. 10A and 10B show diagrams for explaining a best search process executed in a sixth section and an optimization process of reflecting the step number in the sixth section acquired thereby to the set step numbers (set values) of the other sections, and FIG. 10B shows a list of updated map data, in a stage after the optimization process described in FIG. 9.

FIGS. 11A and 11B show diagrams for explaining a best search process executed in the thirteenth section again and an optimization process of reflecting the step number in the thirteenth section acquired thereby to the set step numbers (set values) of the other sections, and FIG. 11B shows a list of updated map data, in a stage after the optimization process described in FIG. 10.

FIG. 13A shows basic step numbers of a control map stored in a memory at the time of factory shipment as a line and FIG. 13B shows a list of data included in the control map.

FIGS. 14A and 14B show diagrams for explaining a second method, including FIG. 14A showing a diagram for explaining that the step numbers (set values) of the other sections are corrected based on the step number acquired by the best search performed in the idle state (third section) when the engine of the working machine is activated and FIG. 14B showing a list of updated data.

FIGS. 15A and 15B show diagrams for explaining that the step numbers (set values) of the other sections are corrected based on the best search performed in the thirteenth section and the step number in the thirteenth section acquired thereby, and FIG. 15B shows a list of updated data, in a stage after the optimization process described in FIG. 14.

FIGS. 16A and 16B show diagrams for explaining that the step numbers (set values) of the other sections are corrected based on the best search performed in the sixteenth section (WOT) and the step number in the sixteenth section acquired thereby, and FIG. 16B shows a list of updated data, in a stage after the optimization process described in FIG. 15.

FIGS. 17A and 17B show diagrams for explaining a control map in the embodiment, including FIG. 17A showing a basic step number (original set value) of the control map stored in a memory at the time of factory shipment as a line and FIG. 17B showing a list of map data included in the control map.

FIGS. 18A and 18B show diagrams for explaining a third method, including FIG. 18A showing a diagram for explaining that the step numbers (set values) of the other sections are corrected based on the best search performed in the third section in the idle state when the engine of the working machine is activated and the step number (set value) in the third section acquired thereby, and FIG. 18B showing a list of updated data.

FIGS. 19A and 19B show diagrams for explaining that the step numbers (set values) of the other sections are corrected based on the best search performed in the thirteenth section and the step number in the thirteenth section acquired thereby, and FIG. 19B shows a list of updated data, in a stage after the optimization process described in FIG. 18.

DETAILED DESCRIPTION OF THE PRESENT INVENTION

Figure 1:
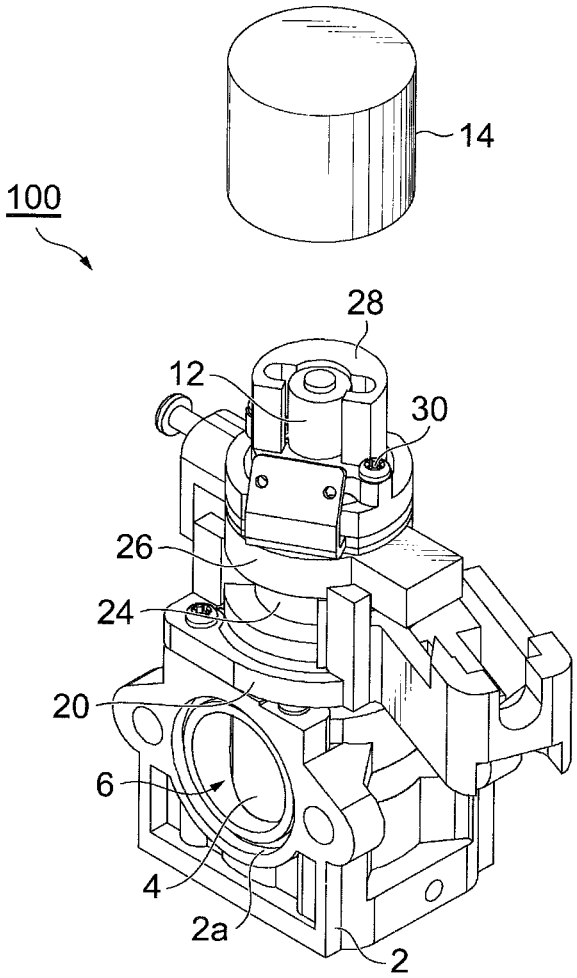
FIG. 1 shows a perspective view of a rotary carburetor mounted on a working machine of an embodiment.
Figure 2:
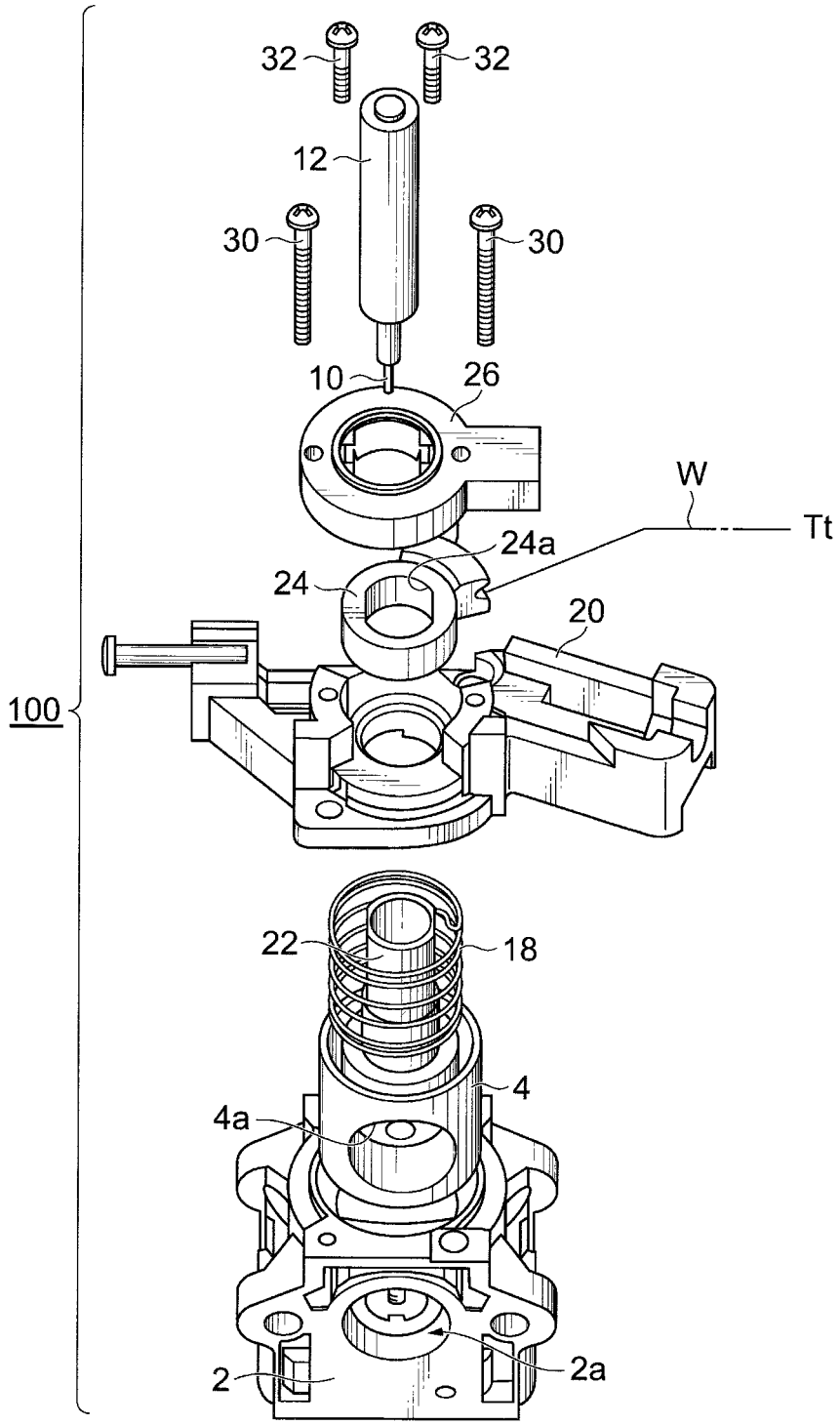
FIG. 2 shows an exploded perspective view of the rotary carburetor shown in FIG. 1.
Figure 3:
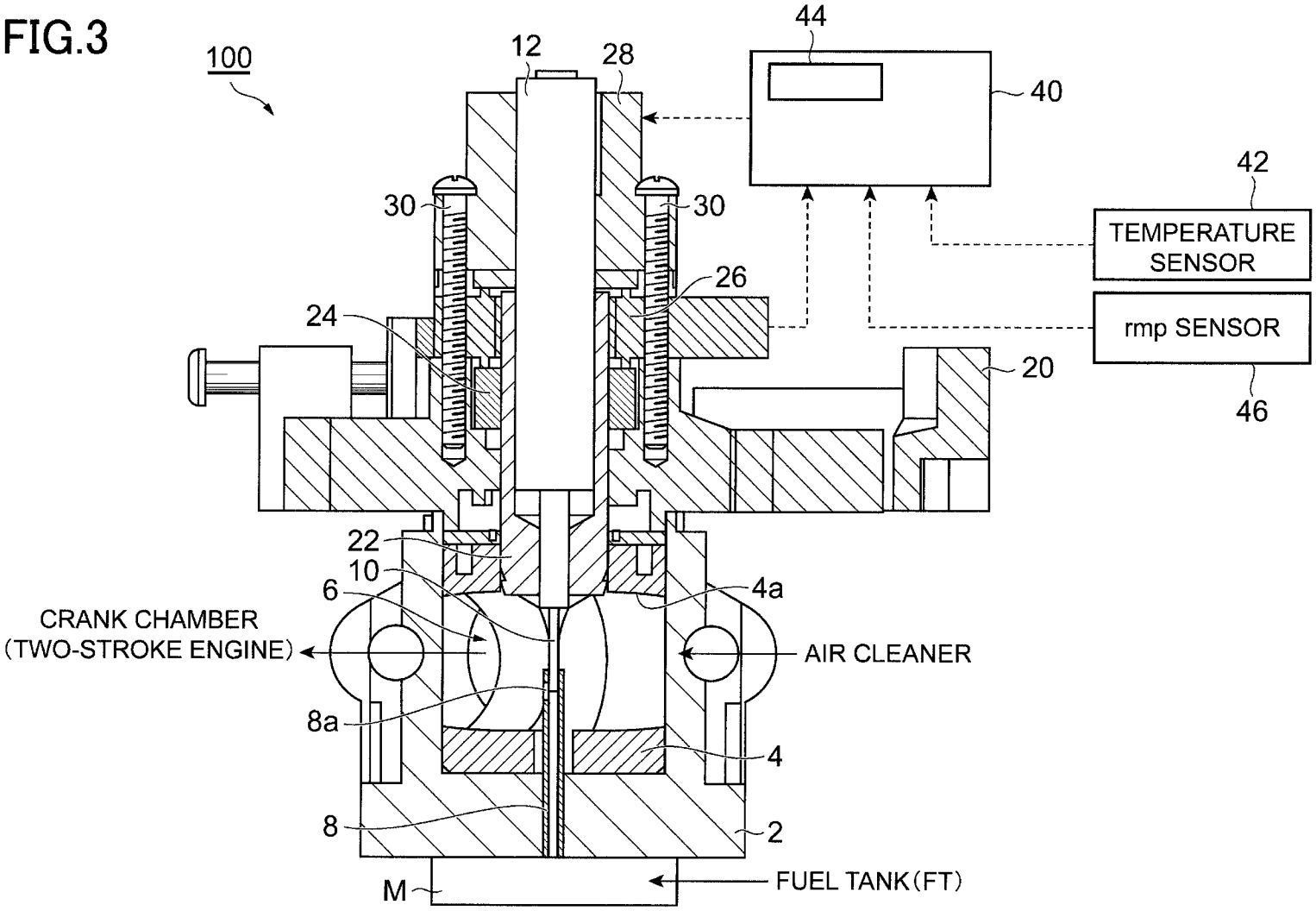
FIG. 3 shows a cross-sectional view of the rotary carburetor shown in FIG. 1.

Preferred embodiments of the present invention will now be described with reference to the accompanying drawings. FIGS. 1 to 3 show a rotary carburetor mounted on a portable working machine according to the present invention. FIG. 1 is a perspective view. FIG. 2 is an exploded perspective view. FIG. 3 is a longitudinal cross-sectional view. The shown rotary carburetor is typically incorporated in a two-stroke internal combustion engine and constitute a portion of a fuel supply system of the two-stroke internal combustion engine. The shown rotary carburetor may be incorporated into a four-stroke internal combustion engine and the rotary carburetor may constitute a portion of a fuel supply system of the four-stroke internal combustion engine.

The portable working machine according to the present invention may be a brush cutter, a chain saw, a power blower, a trimmer, etc. and may be a handheld-type working machine or a backpack-type working machine.

Referring to FIGS. 1 to 3, a shown rotary carburetor 100 has a carburetor main body 2, and a columnar rotary valve main body 4 constituting an output control valve is received in an axis-rotatable manner in the carburetor main body 2. This rotary valve main body 4 is not displaced in the axial direction.

As in the conventional case, the carburetor main body 2 has two openings 2*a* (FIG. 2) opposed to each other. The cylindrical rotary valve main body 4 has one through-hole 4*a*. This through-hole 4*a* forms an intra-carburetor air passage 6 together with the two openings 2*a*, and an air-fuel mixture is generated in this intra-carburetor air passage 6.

The axial rotation of the cylindrical rotary valve main body 4 controls an effective passage cross-sectional area of the intra-carburetor air passage 6, i.e., a throttle valve opening degree, as in the conventional case.

Referring to FIG. 3, the rotary carburetor 100 has a fuel nozzle 8 fixed to the carburetor main body 2 as in the conventional case. The fuel nozzle 8 is a member constituting a fuel discharge part discharging fuel into the intra-carburetor air passage 6. The fuel nozzle 8 extends upward on the axis of the rotary valve main body 4 and penetrates the rotary valve main body 4 into the intra-carburetor air passage 6. The fuel nozzle 8 communicates with a metering chamber M, and fuel is supplied from a fuel tank FT to the metering chamber M.

The rotary valve main body 4 is rotatable around an axis coaxial with the stationary fuel nozzle 8. A tip portion (upper portion) of the nozzle 8 is provided with a fuel discharge port 8*a* in a circumferential wall thereof (FIG. 3). The fuel discharge port 8*a* constitutes a "fuel discharge part" supplying fuel to the intra-carburetor air passage 6. A lower portion of the nozzle 8 constitutes a "fuel supply passage" for supplying fuel from the metering chamber M to the fuel discharge port 8*a*. Therefore, the fuel is sucked out from the fuel discharge port 8*a* by the air passing through the intra-carburetor air passage 6. As a result, an air-fuel mixture is generated in the intra-carburetor air passage 6. The air-fuel mixture is supplied to a crank chamber of the two-stroke internal combustion engine as in the conventional case (FIG. 3).

As can be clearly seen from the figure, a portion of the needle 10 is inserted into the fuel nozzle 8 as in the conventional case. Specifically, the needle 10 is disposed on the axis of the rotary valve main body 4, and the needle 10 is coaxial with the fuel nozzle 8. A tip portion (lower end portion) of the needle 10 is inserted in the fuel nozzle 8. The valve opening degree, i.e., the effective opening area of the fuel discharge port 8*a*, is defined by the inserted end of the needle 10. In other words, the needle 10 functions as a valve adjusting the opening degree of the fuel discharge part, and the opening degree of the fuel discharge part is defined by the position of the needle 10.

The needle 10 constitutes a portion of an electric valve. The needle 10 is provided with a drive mechanism component 12 vertically displacing the needle 10 along the axis thereof (FIGS. 1 and 2). The drive mechanism component 12 includes a conversion mechanism using a screw thread, for example, and converts a rotational movement to a linear movement. A stepping motor 14 (FIG. 1) serving as an electric actuator, specifically a non-magnetic actuator, is coupled to the drive mechanism component 12. The stepping motor 14 vertically displaces the needle 10 to variably control the valve opening, i.e., the effective opening area of the fuel discharge port 8*a*. The needle 10 including the stepping motor 14 is not magnetized and therefore advantageously eliminates the possibility of adsorption of iron powder, unlike a solenoid valve.

In general, since solenoid valves are most common electric valves and are advantageous in that the valves are relatively inexpensively available, control using a solenoid valve has a large practical value. However, if a solenoid valve is used for fuel control, a problem occurs since the solenoid valve includes an electromagnet. The solenoid valve is magnetized during operation. The magnetized valve attracts metal powder. The metal powder is then adsorbed to the valve and causes malfunction of the valve.

Reference numeral 18 shown in FIG. 2 denotes a return spring, and reference numeral 20 denotes a cover member. The carburetor main body 2 receiving the rotary valve main body 4 constituting the output control valve is closed by the cover member 20. The return spring 18 is interposed between the cover member 20 and the rotary valve main body 4.

The rotary valve main body 4 has a cylindrical throttle shaft 22 extending upward (FIGS. 2 and 3), and this hollow throttle shaft 22 extends upward through the cover member 20. The throttle shaft 22 is rotatable relative to the cover member 20. The outer circumferential surface of the throttle shaft 22 has a non-circular irregular cross-sectional shape (FIG. 2). The cover member 20 is fixed to the carburetor main body 2.

A throttle lever 24 and a position sensor 26 are arranged around the throttle shaft 22. The position sensor 26 has a ring-shaped case and the case is arranged coaxially with the throttle shaft 22. The case of the position sensor 26 has a shape surrounding at least a portion of the circumference of the throttle shaft 22 and is fixed to the cover member 20 by a fixing member 28 (FIG. 1) surrounding an upper end portion of the drive mechanism component 12, and first bolts 30. The fixing member 28 is not shown in FIG. 2. The drive mechanism component 12 is fastened to the fixing member 28 by second bolts 32 and the drive mechanism component 12 is received in the hollow throttle shaft 22.

The throttle lever 24 has an opening 24*a* (FIG. 2) receiving the throttle shaft 22 and the opening 24*a* has an irregular shape complementary to the throttle shaft 22. With this configuration, the throttle lever 24 is coupled to the throttle shaft 22, i.e., the rotary valve main body 4 in a relatively non-rotatable manner.

Referring to FIG. 2, the throttle lever 24 is mechanically linked through a wire W to a throttle trigger Tt. The throttle trigger Tt is an output control operating member for operation by an operator. When the operator operates the throttle trigger Tt, the movement of the throttle lever 24 interlocking with this operation causes the rotary valve main body 4 to rotate around an axis. A passage effective cross-sectional area of the intra-carburetor air passage 6, i.e., a throttle opening degree, is defined by the axial rotation of the rotary valve main body 4.

The linkage between the rotary valve main body 4 serving as the output control valve and the throttle trigger Tt serving as the output control operating member is not limited to the mechanical coupling through the wire W described above. As disclosed in Japanese Laid-Open Patent Publication No. H04(1992)-255535, a motor driving the output control valve and a control means (CPU) controlling this motor may be disposed to electronically couple the output control valve and the output control operating member.

The ring-shaped position sensor 26 arranged around the throttle shaft 22 can continuously detect a rotational position of the throttle lever 24, i.e., a rotational position of the rotary valve body 4. Therefore, the throttle opening degree can linearly and continuously be detected from full close to full open by the position sensor 26. In a modified example, the position sensor 26 serving as a throttle opening degree detection sensor detecting the throttle opening degree may detect the throttle opening degree in multiple stages or multiple steps.

The throttle opening degree detected by the position sensor 26 serving as the throttle opening degree detection sensor is used for the fuel supply control. Describing an outline of the fuel supply control, first, a control map is prepared such that the throttle opening degree is divided into multiple sections from full close (throttle opening degree: 0%) to wide open or full open (throttle opening degree: 100%) according to a level thereof. The map has the multiple sections divided according to a level of the throttle opening degree. The multiple sections include a step number (set value) of the stepping motor 14 set for each of the sections. This step number is the step number at which the engine rotation speed is highest in each of the sections.

It is assumed that the throttle opening degree from 0% to 100% is divided into "10" as follows.

(1) First section: opening degree of 0% to opening degree less than 10%

(2) Second section: opening degree of 10% to opening degree less than 20%

(3) Third section: opening degree of 20% to opening degree less than 30%

(4) Fourth section: open degree of 30% to opening degree less than 40%

(5) Fifth section: opening degree of 40% to opening degree less than 50%

(6) Sixth section: opening degree of 50% to opening degree less than 60%

(7) Seventh section: opening degree of 60% to opening degree less than 70%

(8) Eighth section: opening degree of 70% to opening degree less than 80%

(9) Ninth section: opening degree of 80% to opening degree less than 90%

(10) Tenth section: opening degree of 90% to opening degree of 100%

The throttle opening degree detected by the position sensor 26 should belong to any of the first to tenth sections. As described above, each of the sections has the step number of the stepping motor 14, i.e., the position of the needle 10 (valve opening degree: the opening degree of the fuel discharge port), set therein. For this step number, the manufacturer sets an optimum value in advance for each section before shipment. The optimum value is a value at which the engine rotation speed is highest in each of the sections. By this step number, the effective opening area of the fuel discharge port 8*a* is defined in each of the sections as described below.

(1) First section: a first step number (first position of the needle 10), i.e., a first effective opening area (first valve opening degree) of the fuel discharge port 8*a*

(2) Second section: a second step number (second position of the needle 10), i.e., a second effective opening area (second valve opening degree) of the fuel discharge port 8*a*

(3) Third section: a third step number (third position of the needle 10), i.e., a third effective opening area (third valve opening degree) of the fuel discharge port 8*a*

(4) Fourth section: a fourth step number (fourth position of the needle 10), i.e., a fourth effective opening area (fourth valve opening degree) of the fuel discharge port 8*a*

(5) Fifth section: a fifth step number (fifth position of the needle 10), i.e., a fifth effective opening area (fifth valve opening degree) of the fuel discharge port 8*a*

(6) Sixth section: a sixth step number (sixth position of the needle 10), i.e., a sixth effective opening area (sixth valve opening degree) of the fuel discharge port 8*a*

(7) Seventh section: a seventh step number (seventh position of the needle 10), i.e., a seventh effective opening area (seventh valve opening degree) of the fuel discharge port 8*a*

(8) Eighth section: an eighth step number (eighth position of the needle 10), i.e., an eighth effective opening area (eighth valve opening degree) of the fuel discharge port 8*a*

(9) Ninth section: a ninth step number (ninth position of the needle 10), i.e., a ninth effective opening area (ninth valve opening degree) of the fuel discharge port 8*a*

(10) Tenth section: a tenth step number (tenth position of the needle 10), i.e., a tenth effective opening area (tenth valve opening degree) of the fuel discharge port 8*a*

When a user operates the throttle trigger Tt, the throttle lever 24 coupled though the wire W to the throttle trigger Tt rotates. When the throttle lever 24 rotates, the rotary valve body 4 rotates. The rotation of the rotary valve body 4 changes the passage effective cross-sectional area of the intra-carburetor air passage 6, i.e., the throttle opening degree.

The rotational position of the throttle lever 24, i.e., the throttle opening degree, is detected by the position sensor 26. The throttle opening degree detected by the position sensor 26 belongs to one of the first to tenth sections. The stepping motor 14 is supplied with the step number (set value of the map) to which the throttle opening degree belongs. For example, when the detected throttle opening degree currently belongs to the second section, the stepping motor 14 is supplied with the second step number. As a result, the position of the needle 10 is positioned at the second position, and the needle 10 at the second position forms the fuel discharge port 8*a* having the second valve opening, i.e., the second effective opening area. When the throttle opening degree is changed by the operation of the operator during a work, i.e., during operation of the engine, the rotational position of the stepping motor 14 (the position of the needle 10) is positioned based on the step number of the section to which the changed throttle opening degree belongs. In this way, the throttle opening degree is constantly detected during the engine operation, and the rotational position (the position of the needle 10) of the stepping motor 14 is positioned based on the step number of the section corresponding to the throttle opening degree detected based on the control map, so that the opening degree of the fuel discharge part is set.

Regarding modification examples, although the number of sections is "10" in the above description, the number of sections is arbitrary. When it is desired to provide more precise control, the number of sections may be set to the number of sections greater than "10" such as "15" and "20", for example. Although equally divided from 0% to 100% in the above example, the throttle opening degree may unequally be divided.

It is preferable to update the set values (step numbers) of the sections while the user is working so as to set the optimum step numbers corresponding to a current environment, a type of fuel, etc. In other words, it is preferable to continuously update the set values of the sections while the user is actually working with the working machine. As a result, the optimization of fuel supply can be implemented to adapt the fuel supply control to the current environment, the type of fuel currently used, etc.

Referring to FIG. 3, the stepping motor 14 is controlled by a control unit 40. To the control unit 40, the throttle opening degree detected by the position sensor 26 is inputted and an engine temperature is input from a temperature sensor 42 and used for determining whether the engine is in a cold state or a warm state. The temperature sensor 42 is optionally disposed. A signal from rpm sensor (rotation speed sensor) 46 is inputted to the control unit 40. The rpm sensor 46 detects an engine rotation speed.

The control unit 40 has a memory 44, and the memory 44 has data, i.e., a control map, for controlling the fuel supply system including the stepping motor 14 stored at the time of factory shipment. As described above, the data for controlling the fuel supply system includes the multiple sections based on the throttle opening degree and the step number of the stepping motor 14, i.e., the position of the needle 10 (the opening degree of the fuel discharge part), set for each of the sections.

The step number of each of the sections included in the map is updated under a certain condition. This process of updating the step number is referred to as an "optimization process", and this optimization process is executed when the operation state of the engine is settled, i.e., during a steady operation. In other words, the optimization process is preferably executed when the operation of the throttle trigger Tt operated by the operator is stable. In other words, when the operator's trigger operation is performed for an acceleration operation, a deceleration operation, and a fine adjustment operation for the position of the throttle trigger Tt, the optimization process is preferably prohibited.

The optimization process includes the following "best search process". In the best search process, the step number set in the map is gradually changed to obtain the step number of the stepping motor 14 at which the engine rotation speed is highest. The step number of the corresponding section of the map is overwritten with the step number obtained by the best search process.

The execution of the optimization process and the best search described above may be canceled in the cold state of the engine. Conversely, by executing the optimization process and the best search described above even in the cold state of the engine, the set value in each section can be optimized also from the cold state of the engine until reaching the warm state.

Figure 5:
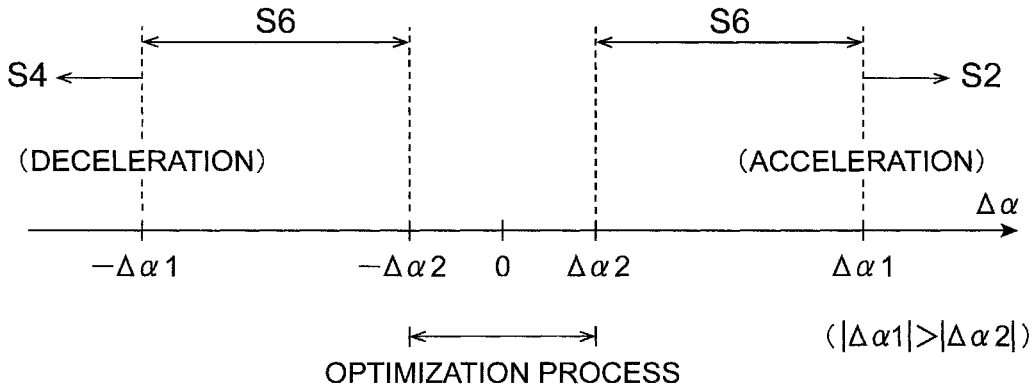
FIG. 5 shows a diagram for explaining an operation state for executing the optimization process limited in FIG. 4.

In an embodiment described below, the fuel supply control is performed based on a map having zeroth to sixteenth sections obtained by dividing the throttle opening degree of 0% (full close) to 100% (wide open or full open) into 17 sections. The optimization process including the best search is executed each time the certain condition is satisfied. FIG. 5 shows a distinction between an operation state in which the optimization process is executed and an operation state in which the process is not executed.

Figure 4:
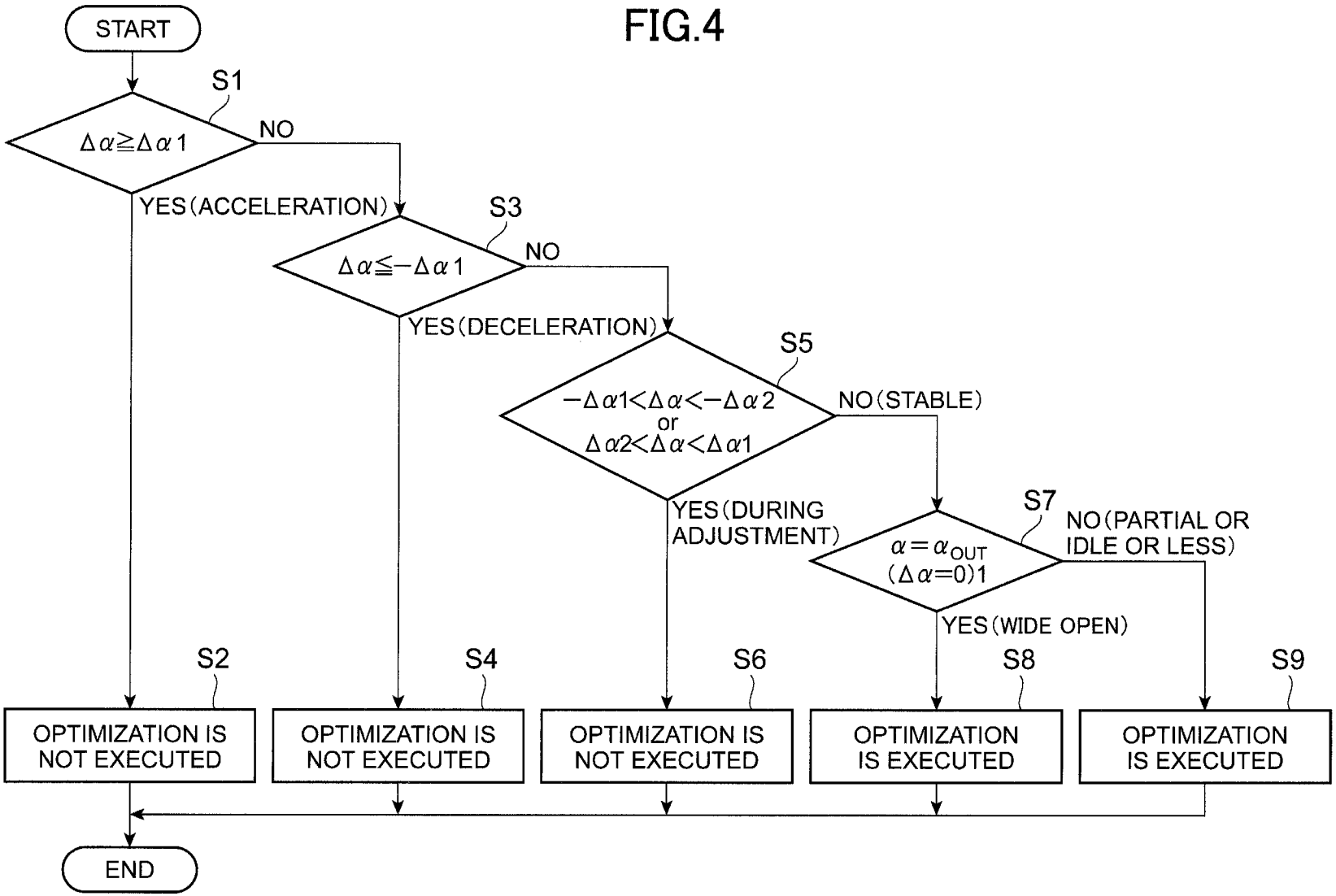
FIG. 4 shows a flowchart of determining whether an operation state is a state for executing an optimization process so as to limit an operation state for executing the optimization process in each section of the control map in the working machine of the embodiment.

In FIGS. 4 and 5, "a" means the throttle opening degree. The throttle opening degree $\alpha$ can be detected by the position sensor 26 described above (FIGS. 2 and 3). "$\Delta\alpha$" means a change amount of the throttle opening degree. At step S1 of FIG. 4, it is determined whether the change amount $\Delta\alpha$ of the throttle opening degree is $\Delta\alpha 1$ or more. In the case of "Yes" at step S1, it is determined that acceleration is in progress, and the process goes to step S2. The optimization process is not executed at step S2.

In the case of "No" at step S1, the process goes to step S3, and it is determined whether the change amount $\Delta\alpha$ of the throttle opening degree is $-\Delta\alpha 1$ or less. In the case of "Yes" at step S3, it is determined that deceleration is in progress, and the process goes to step S4. The optimization process is not executed at step S4.

In the case of "No" at step S3, the process goes to step S5, and it is determined whether the change amount $\Delta\alpha$ of the throttle opening degree satisfies $-\Delta\alpha 1<\Delta\alpha<-\Delta\alpha 2$ or $\Delta\alpha 2<\Delta\alpha<\Delta\alpha 1$ (see FIG. 5). It is noted that $|\Delta\alpha 1|>|\Delta\alpha 2|$. Therefore, at step S5, it is determined whether the operator is searching for a desired engine rotation speed by slightly moving the throttle trigger Tt to acquire a desired engine rotation speed. In the case of "Yes" at step S5, it is determined that the operator is adjusting the position of the throttle trigger Tt, and the process goes to step S6. The optimization process is not executed at step S6.

In the case of "No" at step S5, the process goes to step S7, and it is determined whether the throttle opening degree $\alpha$ is wide open (WOT) and the opening degree of the throttle valve is substantially unchanged ($\Delta\alpha=0$). In the case of "Yes" at step S7, it is determined that the throttle opening degree is stable at the wide-open position, and the process goes to step S8 at which the optimization process is executed. On the other hand, in the case of "No" at step S7, it is determined that the throttle opening degree is stable at a partial or idle opening degree or less, and the process goes to step S9 at which the optimization process is executed.

A first method related to the optimization process will be described with reference to FIGS. 6 to 12. In the first method, in the operation state satisfying the condition described above in the zeroth to sixteenth sections, the best search process is executed in the section corresponding to the throttle opening degree in the operation state, and an update is made by associating to the section the consequently obtained step number (the position of the needle 10) at which the highest engine rotation speed can be achieved. To the set values (step numbers) of the other sections that are not the section in which the best search process is executed, preferably, corrections are made in consideration of the step number obtained by executing the best search process so that the set values of the other sections are updated with corrected step numbers. Specifically, for example, when the best search of the thirteenth section is performed to update the step number of the thirteenth section, the step numbers of the other sections are preferably corrected based on the step number of the thirteenth section. As a result, even when the number of times of the optimization process is small, the step numbers of all the sections can be corrected to substantially proper step numbers.

In a specific way of correcting the other sections as described above, when the best search is completed in a section including a partial throttle opening degree, for example, the thirteenth section, the correction is preferably made by reflecting to the step numbers of the other sections a deviation between the step number obtained thereby and the old step number previous thereto. In another way, for example, when the best search of the thirteenth section is completed, and the step number of the thirteenth section is updated, linear interpolation may be performed between the step numbers of the other sections subjected to the best search immediately before executing the best search of the thirteenth section and the updated step number of the thirteenth section to correct the step numbers of all other sections.

Figure 6A:
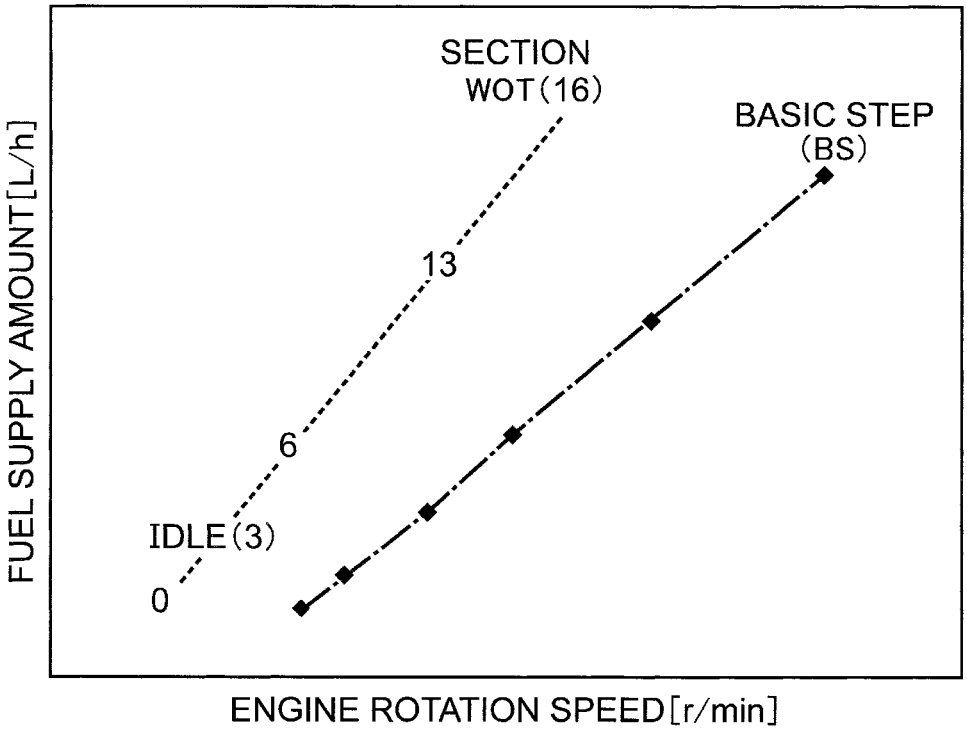

FIG. 6 shows a state at the time of factory shipment. At the time of factory shipment, a map including the step number of the stepping motor 14 (the position of the needle 10: the opening degree of the fuel discharge part) set for each of the zeroth to sixteenth sections is stored in the memory 44 of the control unit 40. The step number of each of the sections at the time of factory shipment is referred to as a basic step "BS", which is indicated by a dashed-dotted line in FIG. 6A. This basic step BS is updated by the optimization process.

In FIG. 6B, a map stored in the memory is shown. Referring to FIG. 6B, an item "step" means the step number of the stepping motor 14.

FIG. 7 shows a state in which the engine is started by the user having obtained the working machine. In this case, the engine is in an idle operation state, and the condition for executing the optimization process is satisfied. The throttle opening degree in the idle operation belongs to the third section. Therefore, the step number of the third section is subjected to the best search. In this best search, the step number stored in the memory is changed within the third section to obtain the step number at which the engine rotation speed is highest. The set value of the third section (the step number: the set opening degree of the fuel discharge part) is updated with the optimum step number obtained by this best search.

Figure 7A:
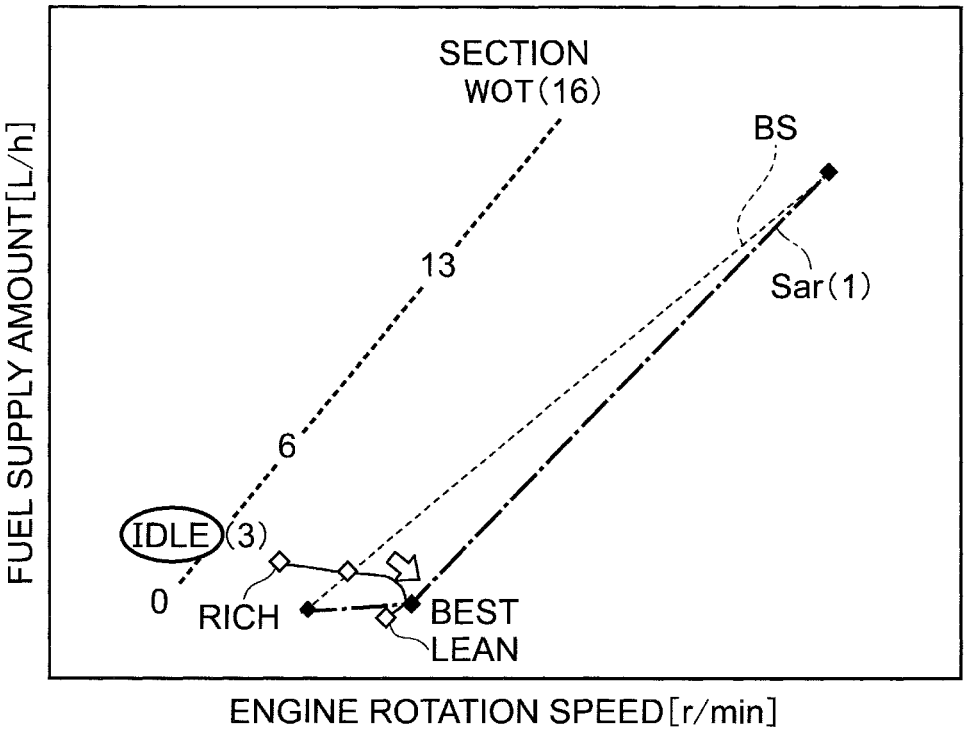

In the best search process, "rich" described in FIG. 7A means that the step number is made slightly larger than the step number stored in the memory 44 (the current set value). Conversely, "lean" described in FIG. 7B means that the step number is made slightly smaller than the current set value. In the best search, as described above, the step number is gradually changed to obtain the step number when the engine rotation speed is highest, and the current step number is updated with the new step number.

FIG. 7 shows a data process after performing the best search in the third section (IDLE). In this data process, a process of reflecting the updated value of the third section to the step numbers of the other sections is executed. Specifically, first, the set step number of the third section is overwritten with the step number obtained by the best search in the third section. Based on the updated step number of the third section and the step number of the sixteenth section (WOT) in the basic step BS set before factory shipment, the step numbers of the fourth to fifteenth sections therebetween are obtained by linear interpolation, and the step numbers of the sections are updated with the step numbers obtained by the linear interpolation. Similarly, based on the updated step number of the third section and the step number of the zeroth section in the basic step BS, the step numbers of the first and second sections therebetween are obtained by linear interpolation and are updated with the step numbers of the sections obtained by the linear interpolation. Linearly interpolated data is denoted by reference numeral Sar(1) in FIG. 7A.

Figure 8A:
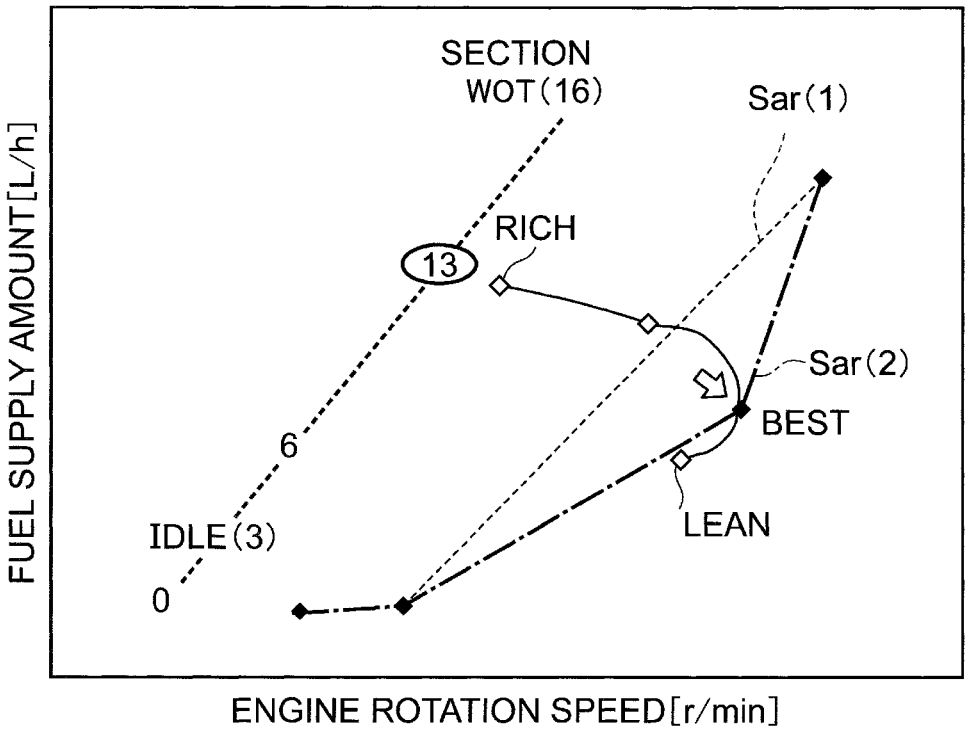

FIG. 8 shows a data process after the best search is performed in the thirteenth section in the optimization process in the next stage subsequent to the best search in the third section for updating the step number of the third section (FIG. 7) and the optimization of the other sections with this step number. The set value (step number) of the thirteenth section is updated with the step number obtained by performing the best search in the thirteenth section. Based on the new step number of the thirteenth section obtained by this best search and the step number of the sixteenth section (WOT) in the data Sar(1) obtained by the immediately preceding optimization process, the step numbers of the fourteenth and fifteenth sections are obtained by linear interpolation. The step numbers of the fourteenth and fifteenth sections are updated with the step numbers obtained by the linear interpolation. Similarly, based on the new updated set value (step number) of the thirteenth section and the step number of the third section (IDLE) in the data Sar(1) obtained by the immediately preceding optimization process, the step numbers of the fourth to twelfth sections therebetween are obtained by linear interpolation, and the step numbers of the fourth to twelfth sections are updated with the step numbers obtained by this linear interpolation. Data after the linear interpolation is denoted by reference numeral Sar(2) in FIG. 8A.

Figure 9A:
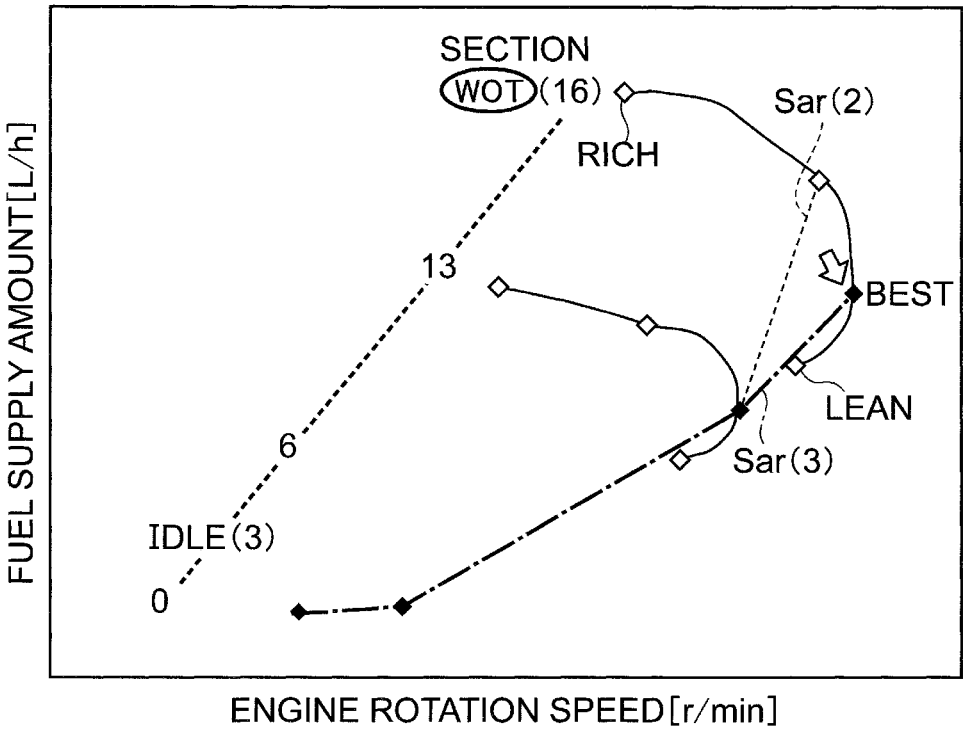

FIG. 9, shows a data process after the best search is performed in the sixteenth section in the next stage after the optimization process in which the best search is performed in the thirteenth section and the step numbers of the other sections are updated based thereon. First, the set value (step number) of the sixteenth section is overwritten with the step number acquired by the best search in the sixteenth section. Based on the updated step number of the sixteenth section and the set value (step number) of the thirteenth section in the data Sar(2) obtained by the immediately preceding optimization process, the step numbers of the fourteenth and fifteenth sections therebetween are obtained by linear interpolation, and the step numbers of the fourteenth and fifteenth sections are updated with the step numbers obtained by this linear interpolation. Linearly interpolated data is denoted by reference numeral Sar(3) in FIG. 9A.

Figure 10A:
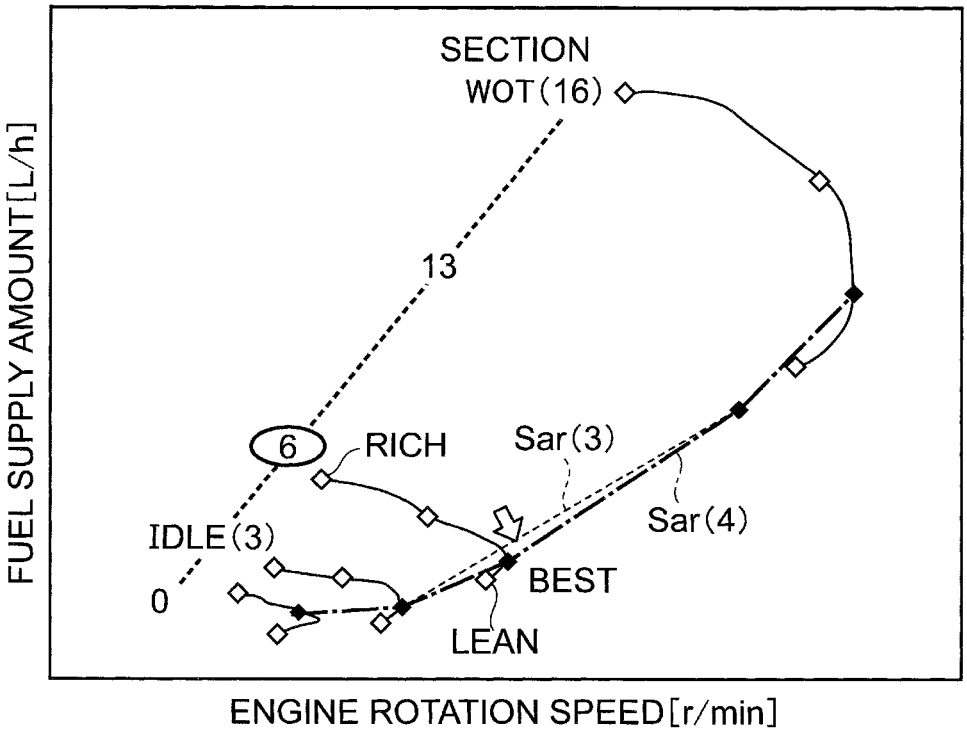

FIG. 10 shows a data process after the best search is performed in the sixth section in the next stage after execution of the optimization process (FIG. 9) in which the best search is performed in the sixteenth section (WOT) and the step numbers of the other sections related thereto are corrected when the condition described above is satisfied at wide open throttle (WOT). The step number of the sixth section is overwritten with the step number (the position of the needle 10: the set opening degree of the fuel discharge part) acquired by the best search of the sixth section. Based on the set step number of the sixth section acquired by the best search and the set step number of the thirteenth section in the data Sar(3) obtained by the immediately preceding optimization process, the set step numbers of the seventh to twelfth sections therebetween are obtained by linear interpolation, and the set step numbers of the seventh to twelfth sections are updated with the step numbers of the sections obtained by this linear interpolation. Additionally, based on the step number of the sixth section acquired by the current best search and the step number of the third section (IDLE) in the data Sar(3), the step numbers of the fourth and fifth sections therebetween are obtained by linear interpolation, and the set step numbers of the fourth and fifth sections are updated with the step numbers obtained by this linear interpolation. The step numbers obtained by linear interpolation are denoted by reference numeral Sar(4) in FIG. 10A.

Figure 11A:
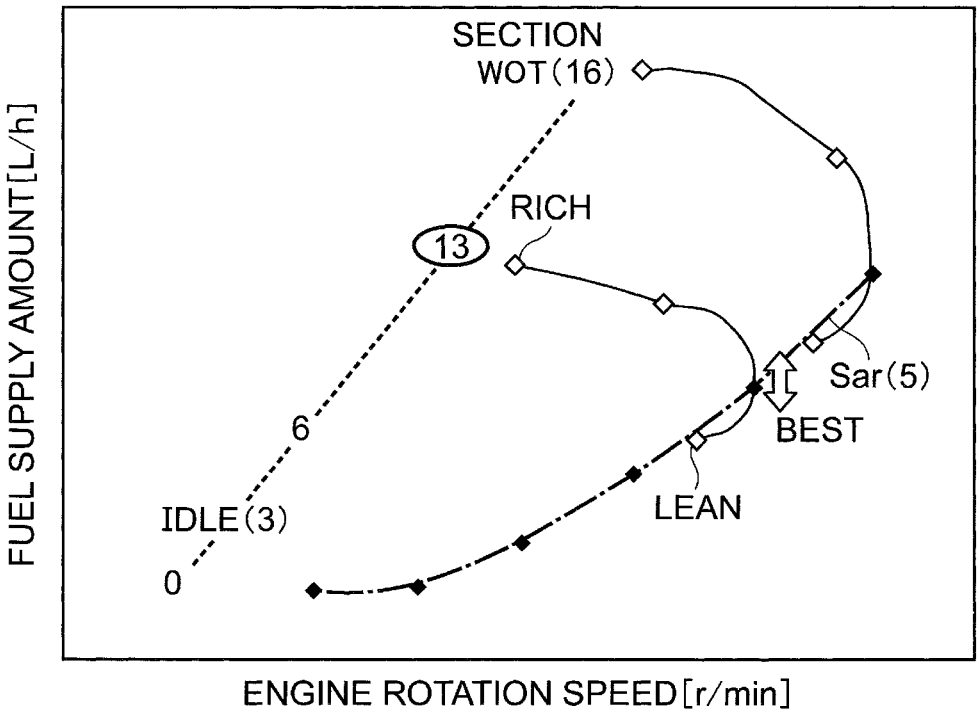

In FIG. 11, after executing the optimization process (FIG. 10) including the best search in the sixth section and the correction of the step numbers of the other sections associated thereto, when the certain condition described above is satisfied in the operation state belonging to the thirteenth section, the optimization process in the thirteenth section is executed. Therefore, the best search in the thirteenth section is performed again. The step number of the thirteenth section is overwritten with the step number (the position of the needle 10) acquired by the best search performed again in the thirteenth section. Based on the step number of the thirteenth section and the step number of the sixth section in the data Sar(4) (FIG. 10) obtained by the immediately preceding optimization process, the step numbers of the seventh to twelfth sections therebetween are obtained by linear interpolation, and the set step numbers of the sections obtained by this linear interpolation are updated. Additionally, based on the step number of the thirteenth section obtained by the best search and the step number of the sixteenth section (WOT) in the data Sar(4) (FIG. 10) obtained in association with the immediately preceding optimization process, the step numbers of the fourth and fifth sections therebetween are obtained by linear interpolation, and the step numbers of the fourth and fifth sections are updated with the step numbers (the positions of the needle 10) obtained by this linear interpolation. Data obtained by linear interpolation is denoted by reference numeral Sar(5) in FIG. 11A.

Figure 12:
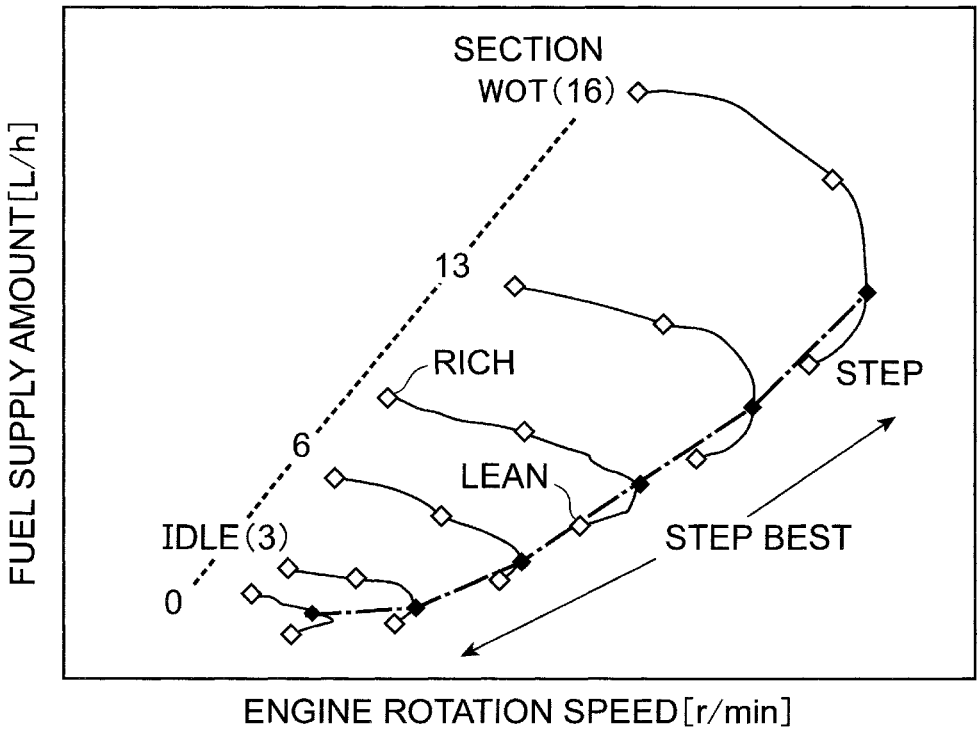
FIG. 12 shows a diagram for explaining that the step number (set value) can be optimized in all the sections by continuously performing the best search in the sections to update the step number with the same method as in FIGS. 7 to 11 and by executing the optimization process of reflecting the updated step number to the set step numbers (set values) of the other sections many times during operation of the engine.

Each time the certain condition described above is satisfied during a work, the optimization process of the set value (step value) of the fuel control map is executed. FIG. 12 is a diagram for explaining that the step numbers of all the sections can be optimized by continuously executing the optimization process of the step numbers of the sections to continue updating the data of the sections. The first method described with reference to FIGS. 6 to 12 uses one section updated with the step number currently obtained by the best search and the linear interpolation for correcting the step number of the sections adjacent thereto based on the step number of the one section. If an already best-searched section exists, it is preferable to use the linear interpolation for making a correction, based on the step number of this best-searched section, for the step numbers of the sections located between these two sections. If no step number is already best-searched in the sections adjacent to the nth section, the linear interpolation may be performed by using the basic step number of the zeroth section, the third section that is the idle region, or the sixteenth section that is the wide-open region at the time of shipment.

Figure 13A:
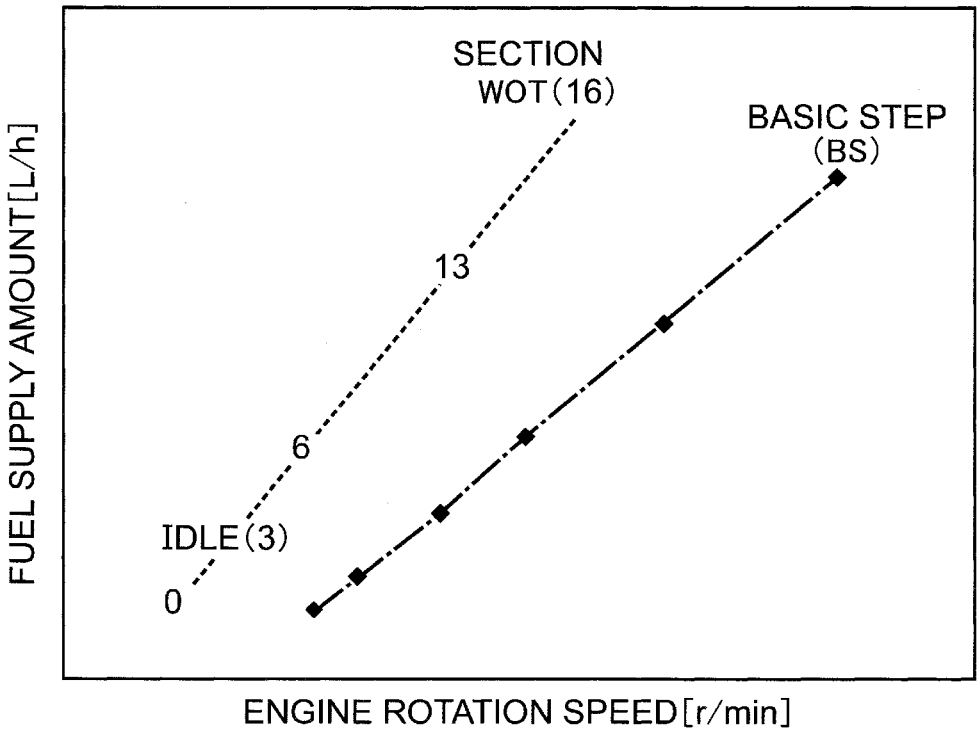
Figure 14A:
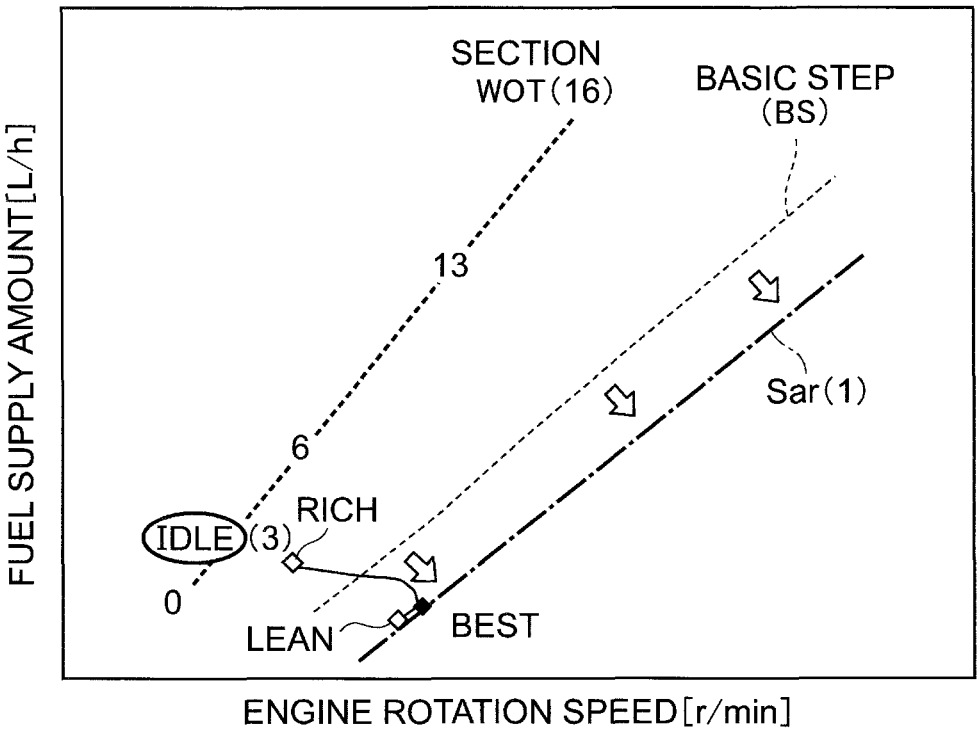

A second method related to the optimization process will be described with reference to FIGS. 13 to 16. FIG. 13 is the same as FIG. 6 described above and shows the state at the time of factory shipment. FIG. 14 shows a state in which the engine is started for the first time by the user having obtained the working machine as in FIG. 7. In this case, the best search is performed in the third section (IDLE) when the certain condition described above is satisfied in the idle operation, and the optimization process is executed for updating the step number (set value) of the third section and the step numbers of the other sections. FIG. 14 shows data after the best search in the third section and the correction of the other sections associated therewith. A difference from the first method (FIG. 7) is that, in this second method, the step numbers of the sections are obtained by correcting the basic step BS of the other sections based on a difference value between the updated step number of the third section (IDLE) and the basic step BS, i.e., the step number set before shipment, of the third section, and the set step numbers of the sections are corrected with the corrected step numbers. As a result, the step numbers of all the other sections can be corrected based on the basic step BS at the time of factory shipment and the step number from the best search in the third section, i.e., the best search during idle operation. In FIG. 14A, the step number after the correction is denoted by reference numeral Sar(1).

Figure 15A:
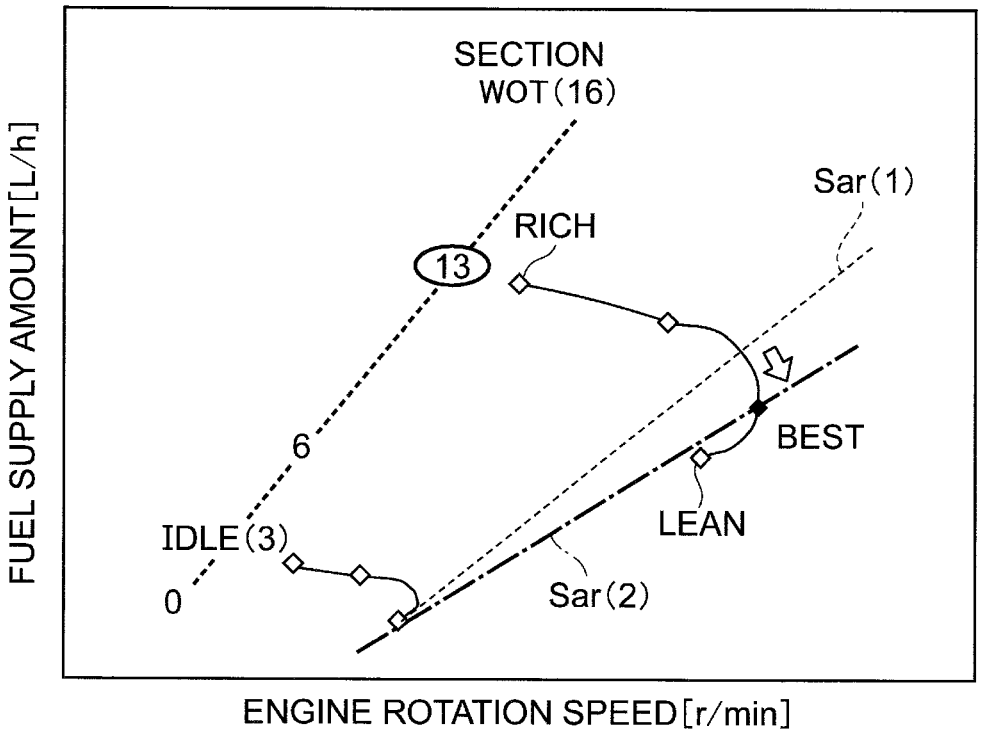

In the next stage of the optimization process (FIG. 14) of performing the best search in the third section, i.e., during idle operation, and correcting the step numbers of the other sections as described above, when the certain condition described above is satisfied in the operation state belonging to the thirteenth section, the optimization process in the thirteenth section is executed. FIG. 15 shows data after performing the best search of the thirteenth section. Based on the step number obtained by the best search in the thirteenth section and the step number of the third section (IDLE) of the previous data Sar(1), the step numbers of all the sections are obtained by linear interpolation. Reference numeral Sar(2) is added to the step numbers obtained in this way.

Figure 16A:
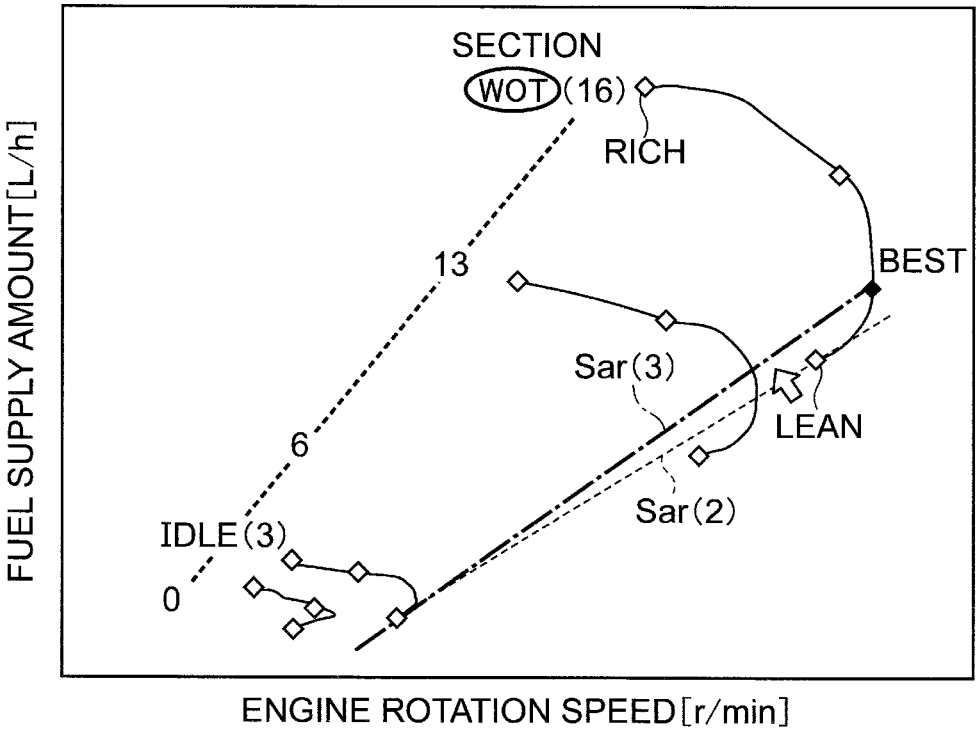

In the next stage of the optimization process (FIG. 15) of performing the best search in the thirteenth section and correcting the step numbers of the other sections as described above, when the certain condition described above is satisfied in the operation state belonging to the sixteenth section (WOT), the optimization process is executed in the sixteenth section. FIG. 16 shows data after performing the best search in the sixteenth section (WOT). Based on the step number (the position of the needle 10) obtained by the best search in the sixteenth section (WOT) and the step number of the third section of the previous data Sar(2), the step numbers of all the other sections are obtained by linear interpolation. Reference numeral Sar(3) is added to data obtained in this way.

Subsequently, when the operation state satisfies the certain condition described above, the best search is performed in the section to which the current throttle opening degree belongs, and the optimization process is continuously executed for correcting the step numbers of the other sections.

Figure 17A:
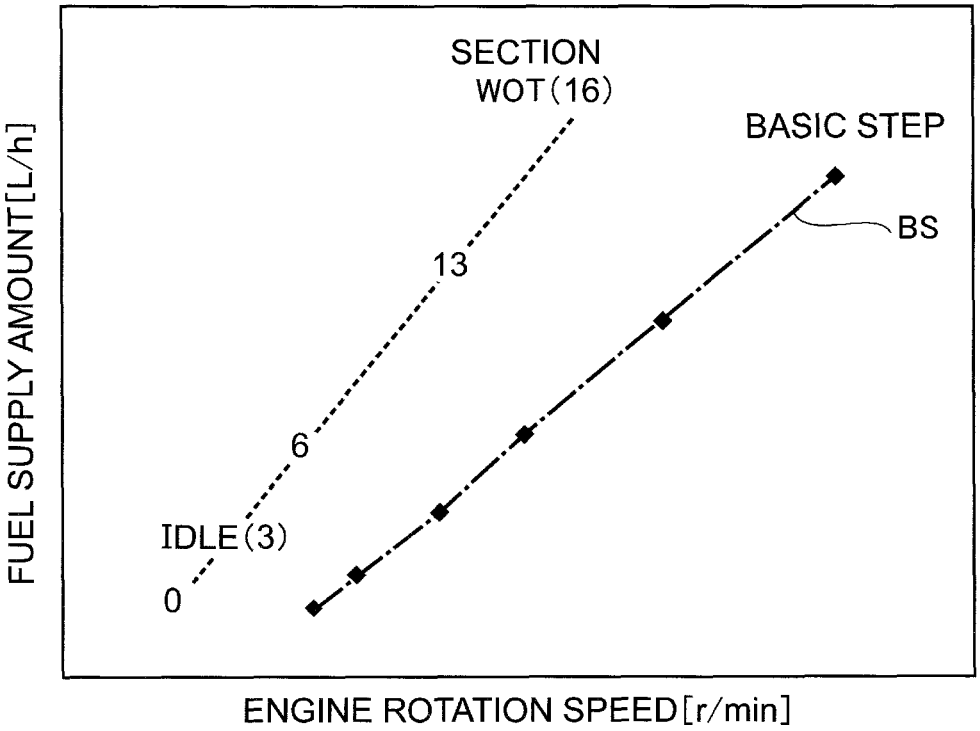
Figure 18A:
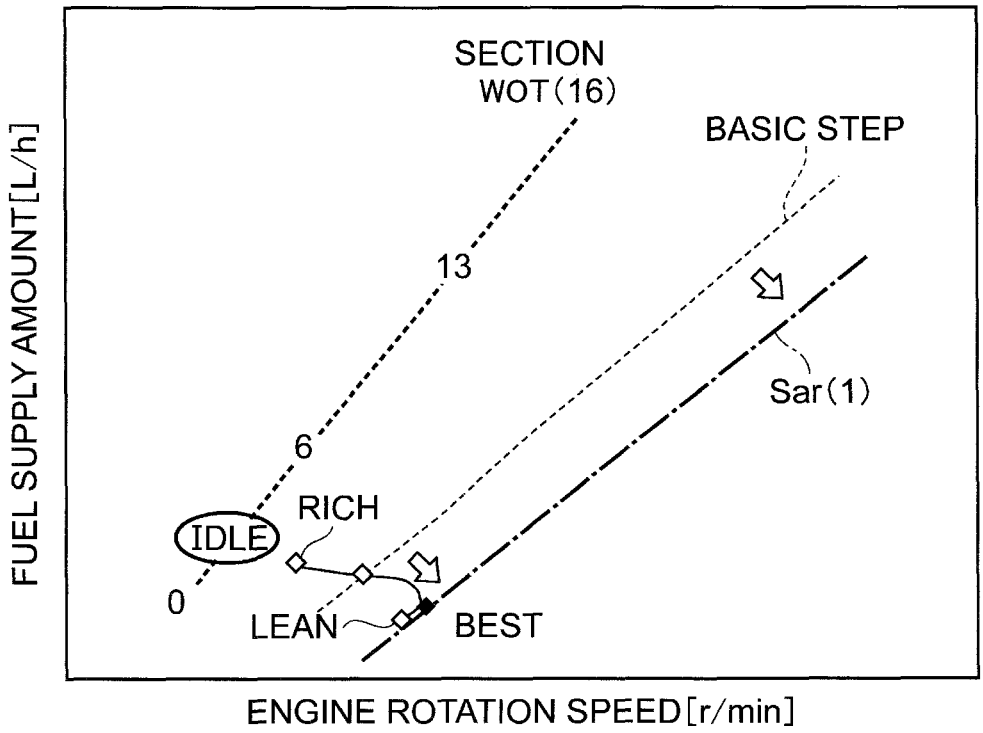

A third method related to the optimization process will be described with reference to FIGS. 17 to 20. FIG. 17 is the same as FIGS. 6 and 13 described above and shows the state at the time of factory shipment. FIG. 18 is the same as FIG. 14 described above and shows a state in which the engine is started by the user having obtained the working machine. When the condition described above is satisfied in the idle operation, the best search is performed in the third section (IDLE). In FIG. 18, the best search is performed in the third section (IDLE) to update the step number and, based on a difference between the updated step number of the third section and the step number of the third section in the basic step BS, the basic step BS of the other sections is corrected to obtain the step numbers as in the second method, and the set step numbers of the sections are updated with these step numbers. As a result, in the basic step BS at the time of factory shipment, the step numbers of the other sections are corrected along with the step number obtained by the best search in the third section. In FIG. 18A, reference numeral Sar(1) is added to stored data after the correction.

Figure 19A:
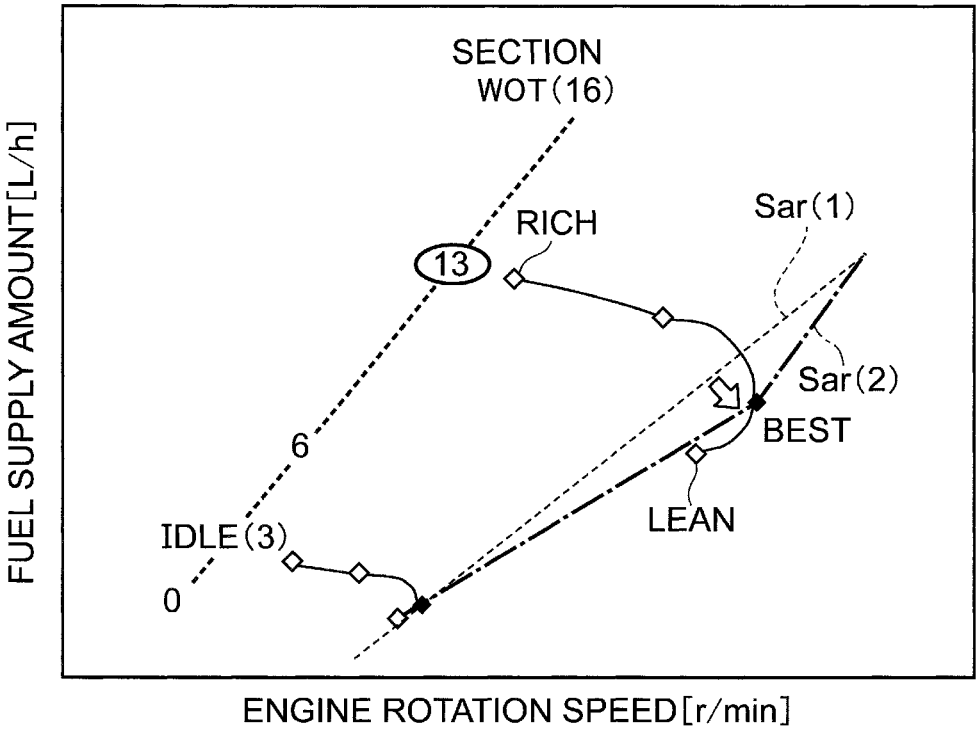

In FIG. 19, when the condition described above is satisfied in an operation state of a partial throttle opening degree, for example, a throttle opening degree belonging to the thirteenth section, a best search in the thirteenth section is performed, and the step number of the thirteenth section is updated with the step number obtained thereby.

The correction of the step numbers of the other sections is made along with the update of the step number in the thirteenth section. Specifically, based on the step number obtained by the best search in the thirteenth section and the step number of the sixteenth section (wide open) in the previously obtained correction data Sar(1), the step numbers of the fourteenth and fifteenth sections are obtained by linear interpolation. Similarly, based on the updated step number of the thirteenth section and the step number of the third section (IDLE) in the previously obtained correction data Sar(1), the step numbers of the fourth to twelfth sections are obtained by linear interpolation, and the step numbers of the sections are updated with the step numbers obtained by the linear interpolation. Reference numeral Sar(2) is added to the step numbers of the sections after the update.

Figure 20:
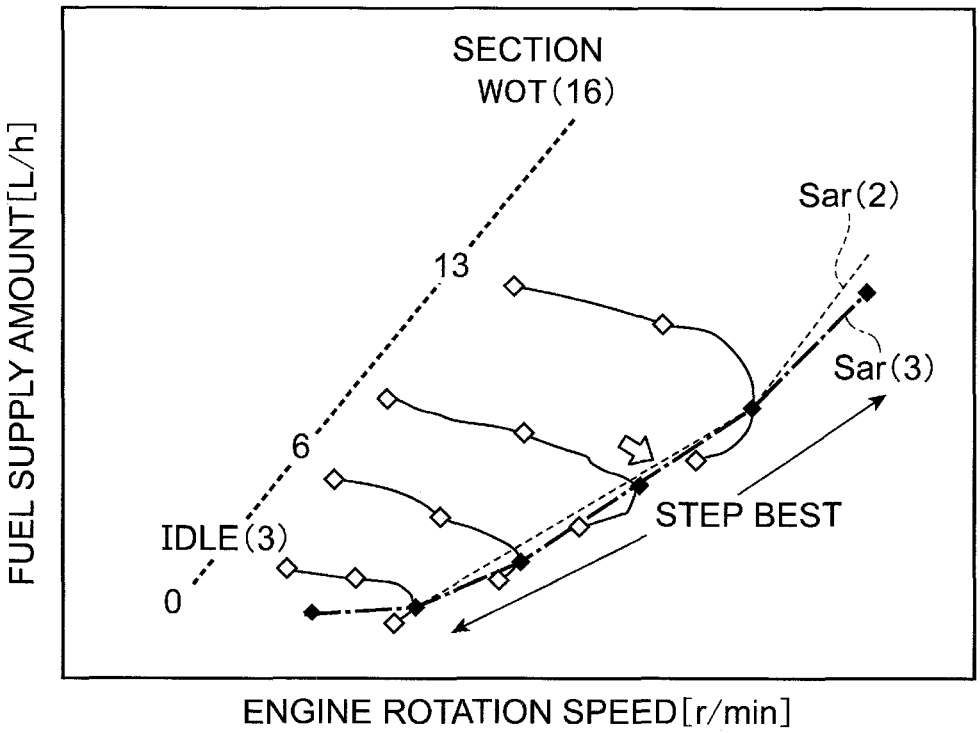
FIG. 20 shows a diagram for explaining that the step number (set value) can be optimized in all the sections during operation of an engine by continuously performing the best search at each throttle opening degree to update the step number in each section included in a map with the third method and by continuously reflecting the updated step number to the step numbers (set values) of the other sections.

In FIG. 20, when the condition described above is sequentially satisfied, for example, in the operation at a partial throttle opening degree such as the sixth section, the nth section, and the thirteenth section, the best search is performed in the corresponding section, and the step numbers (set values) of the other sections are corrected. As a result, the step number at the partial throttle opening degree is optimized by the best search performed in the actual driving state. Reference numeral Sar(3) is added to corrected data obtained in this way. As a result, the set values (step numbers) of all the sections, particularly the partial sections, included in the map of the fuel supply control can be updated during operation each time the constant condition described above is satisfied, so as to optimize the fuel supply control.

Figure 21:
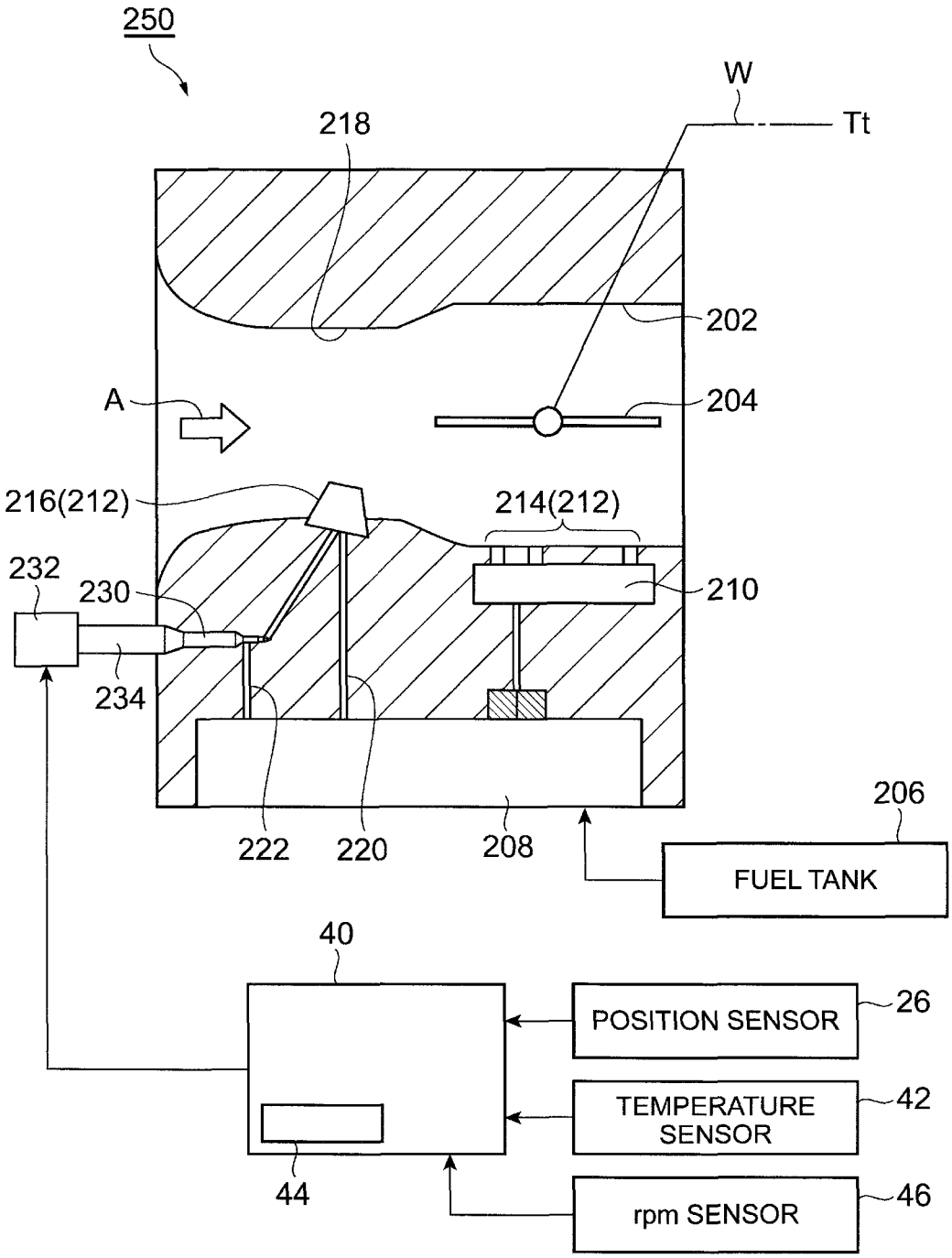
FIG. 21 is a diagram for explaining a specific configuration of a butterfly-valve carburetor for explaining that the present invention is applicable to an engine with a butterfly-valve carburetor.
Figure 22:
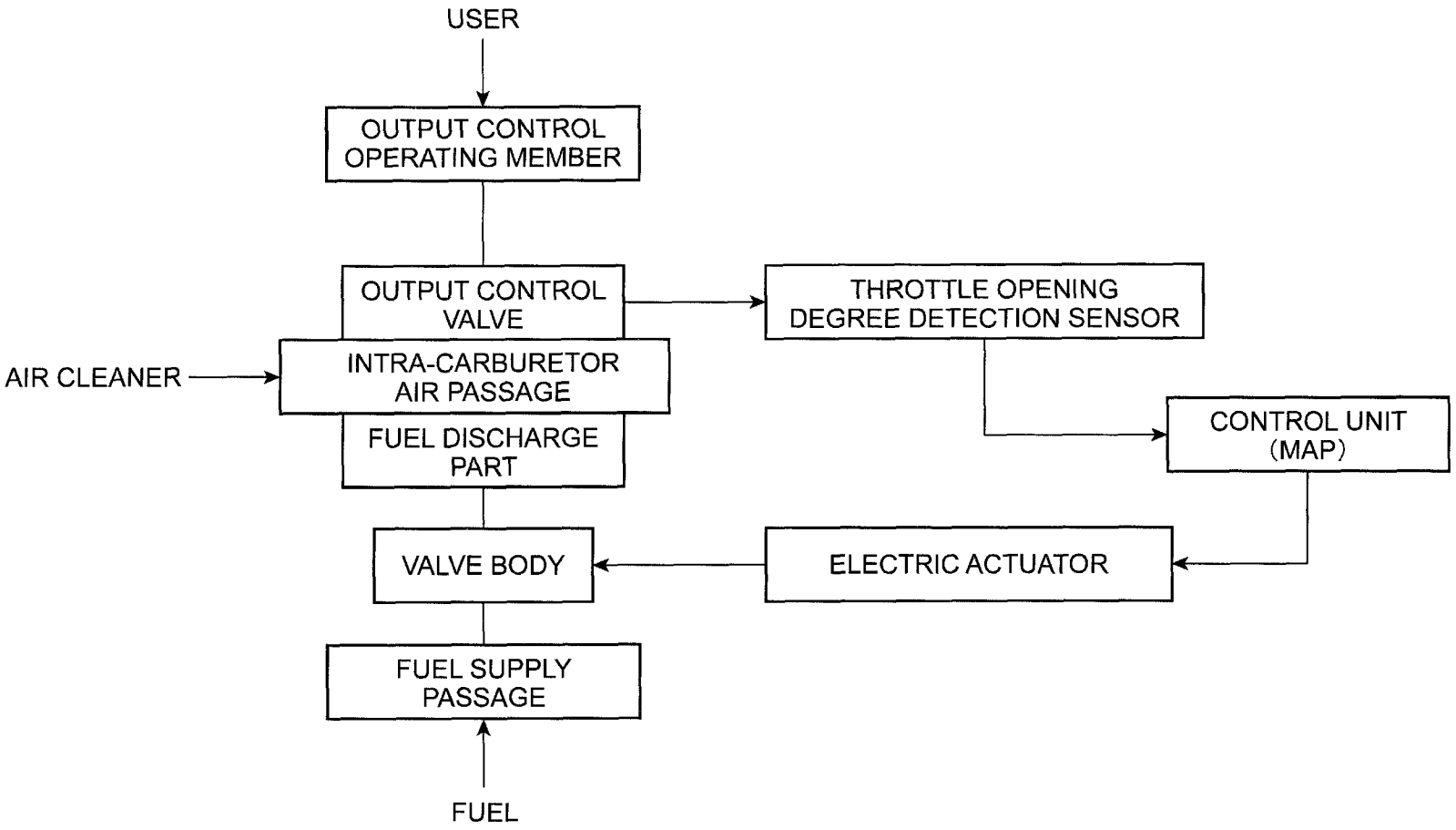
FIG. 22 is a block diagram for explaining a concept of the present invention.

Although the embodiments of the present invention have been described taking as an example the working machine equipped with the two-stroke internal combustion engine including the rotary carburetor 100, the present invention is applicable to a working machine including a butterfly-valve carburetor. FIG. 21 is a diagram for explaining an example in which the present invention is applied to a portable working machine equipped with an engine including a butterfly-valve carburetor.

In FIG. 21, a butterfly-valve carburetor 250 has an intra-carburetor air passage 202, and air filtered by an air filter passes through the intra-carburetor air passage 202. The flow of air is indicated by an arrow "A". In the intra-carburetor air passage 202, a butterfly valve 204 serving as an output control valve is disposed. The butterfly valve 204 is mechanically linked through the wire W to the throttle trigger Tt described above. An operator can operate the throttle trigger Tt and thereby open and close the butterfly valve 204 to adjust the throttle opening degree such that a desired operation state is achieved.

The butterfly-valve carburetor 250 has a metering chamber 208 storing the fuel drawn from a fuel tank 206 and has a slow system chamber 210 to which fuel is supplied from the metering chamber 208. A fuel discharge part 212 discharging fuel to the intra-carburetor air passage 202 has a slow system discharge part 214 communicating with the slow system chamber 210 and a main discharge part 216 communicating with the metering chamber 208. The slow system discharge part 214 is disposed to face the butterfly valve 204. The main discharge part 216 is disposed in a fixed-type venturi part 218 located upstream of the butterfly valve 204.

The metering chamber 208 and the main discharge part 216 communicate with each other through first and second fuel supply passages 220, 222, and a needle valve 230 is interposed in the second fuel supply passage 222. By controlling the valve opening degree of the needle valve 230, the passage opening degree of the second fuel supply passage 222 can be controlled within the range of 0% to 100%. A drive source of the needle valve 230 is a stepping motor 232 serving as an electric actuator, specifically a non-magnetic actuator, and a rotational movement of the stepping motor 232 is converted into a linear movement by a conversion mechanism 234. The fuel supply control according to the present invention can preferably be applied to the control of the stepping motor 232. The position sensor (throttle opening degree detection sensor) 26 described above is disposed to detect the rotational position of the butterfly valve 204.

100 rotary carburetor
4 rotary valve main body (output control valve)
8 fuel nozzle (fuel supply passage)
8*a* fuel discharge port (fuel discharge part)
10 needle
14 stepping motor (electric actuator, non-magnetic actuator)
26 position sensor (throttle opening degree detection sensor)

46 rpm sensor (rotation speed sensor)
40 control unit
42 temperature sensor
M metering chamber (fuel source)
250 butterfly-valve carburetor
216 main discharge part
220 first fuel supply passage
222 second fuel supply passage
230 needle valve
232 stepping motor (electric actuator, non-magnetic actuator)

What is claimed is:

1. A fuel supply control method of a portable working machine driven by an internal combustion engine including a carburetor having an intra-carburetor air passage receiving air filtered by an air cleaner, an output control valve linked to an output control operating member operated by a user and generating a throttle opening degree corresponding to an operation of the output control operating member, a fuel discharge part discharging fuel into the intra-carburetor air passage, a fuel supply passage supplying fuel to the fuel discharge part, a valve body disposed in the fuel discharge part or the fuel supply passage and driven by an electric actuator, the valve body variably controlling an opening degree of the fuel discharge part or the fuel supply passage, and a control map stored onto a memory of a control unit, wherein the control map includes a plurality of sections divided based on the throttle opening degree and an opening degree of the valve body set for each section such that the opening degree of the valve body set for each of the sections is the opening degree of the valve body at which the engine rotation speed is highest in each section, the method comprising:

a throttle opening degree detection step of detecting the throttle opening degree; and a control step of controlling the electric actuator based on the opening degree of the valve body set in a section of the control map to which the throttle opening degree detected at the throttle opening degree detection step belongs.

2. The fuel supply control method of the portable working machine of claim 1, wherein the electric actuator is made up of a non-magnetic actuator.

3. The fuel supply control method of the portable working machine of claim 1, further comprising a data updating step of updating the opening degree of the valve body set in the control map when an operation of the internal combustion engine is stable.

4. The fuel supply control method of the portable working machine of claim 3, wherein the data updating step includes a best search process, wherein in the best search process, in the section of the control map to which the throttle opening degree in the operation state of the internal combustion engine belongs at the time of execution of the data updating step, the opening degree of the valve body is gradually changed to associate the opening degree of the valve body capable of achieving the highest engine rotational speed to the section to perform an update.

5. The fuel supply control method of the portable working machine of claim 4, wherein when the best search process is executed, a change in the opening degree of the valve body of the section updated by the best search process is reflected to the opening degrees of the valve body set in the other sections to update the opening degrees of the valve body of the other sections.

6. The fuel supply control method of the portable working machine of claim 4, wherein the best search process is prohibited when the engine is accelerating.

7. The fuel supply control method of the portable working machine of claim 4, wherein the best search process is prohibited when the engine is decelerating.

8. The fuel supply control method of the portable working machine of claim 1, wherein from a cold state of the engine to a warm state of the engine, the opening degree of the valve body set in each of the sections is updated when a certain condition is satisfied while the engine is operating.

* * * * *